US011706575B2

(12) United States Patent
Lawrence et al.

(10) Patent No.: US 11,706,575 B2
(45) Date of Patent: Jul. 18, 2023

(54) BINAURAL HEARING SYSTEM FOR IDENTIFYING A MANUAL GESTURE, AND METHOD OF ITS OPERATION

(71) Applicant: SONOVA AG, Staefa (CH)

(72) Inventors: Melissa Lawrence, Wetzikon (CH); Alexander Markus, Stäfa (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/507,788

(22) Filed: Oct. 21, 2021

(65) Prior Publication Data

US 2022/0159389 A1 May 19, 2022

(30) Foreign Application Priority Data

Nov. 19, 2020 (EP) ..... 20208695

(51) Int. Cl.
*H04R 25/00* (2006.01)

(52) U.S. Cl.
CPC ..... *H04R 25/552* (2013.01)

(58) Field of Classification Search
None
See application file for complete search history.

(56) References Cited

U.S. PATENT DOCUMENTS

| | | | | |
|---|---|---|---|---|
| 2014/0086438 | A1 | 3/2014 | Tachibana | |
| 2019/0251339 | A1* | 8/2019 | Hawker | G06F 3/017 |
| 2020/0145757 | A1 | 5/2020 | Kraemer | |
| 2020/0314521 | A1 | 10/2020 | El Guindi | |
| 2020/0314523 | A1 | 10/2020 | El Guindi | |
| 2020/0314525 | A1 | 10/2020 | Thielen | |
| 2020/0344536 | A1* | 10/2020 | Jackson | H04R 1/1041 |
| 2020/0380945 | A1* | 12/2020 | Woodruff | H04R 1/1083 |

OTHER PUBLICATIONS

"Extended European Search Report received in EP Application No. 20208695.5-1207 dated Jul. 17, 2021."

* cited by examiner

*Primary Examiner* — Kenny H Truong
(74) *Attorney, Agent, or Firm* — ALG Intellectual Property, LLC

(57) ABSTRACT

The disclosure relates to a hearing system comprising a first hearing device and a second hearing device configured to be worn at a respective ear of a user, each hearing device comprising a displacement sensor configured to provide respective displacement data indicative of a rotational displacement and/or a translational displacement of the hearing device, and a processing unit communicatively coupled to the displacement sensors. The disclosure further relates to a corresponding method of operating a hearing system, and a computer-readable medium storing instructions to perform the method.

15 Claims, 7 Drawing Sheets

BINAURAL HEARING SYSTEM FOR IDENTIFYING A MANUAL GESTURE, AND METHOD OF ITS OPERATION

RELATED APPLICATIONS

The present application claims priority to EP Patent Application No. 20208695.5, filed Nov. 19, 2020, the contents of which are hereby incorporated by reference in their entirety.

BACKGROUND INFORMATION

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to output sound based on an audio signal which may be communicated by a wire or wirelessly to the hearing device. A hearing device may also be used to reproduce a sound in a user's ear canal detected by a microphone. The reproduced sound may be amplified to account for a hearing loss, such as in a hearing instrument, or may be output without accounting for a hearing loss, for instance to provide for a faithful reproduction of detected ambient sound and/or to add sound features of an augmented reality in the reproduced ambient sound, such as in a hearable. A hearing device may also provide for a situational enhancement of an acoustic scene, e.g. beamforming and/or active noise cancelling (ANC), with or without amplification of the reproduced sound. Different types of hearing devices configured to be be worn at an ear include earbuds, earphones, hearables, and hearing instruments such as receiver-in-the-canal (RIC) hearing aids, behind-the-ear (BTE) hearing aids, in-the-ear (ITE) hearing aids, invisible-in-the-canal (IIC) hearing aids, completely-in-the-canal (CIC) hearing aids, cochlear implant systems configured to provide electrical stimulation representative of audio content to a user, a bimodal hearing system configured to provide both amplification and electrical stimulation representative of audio content to a user, or any other suitable hearing prostheses. A hearing system comprising two hearing devices configured to be worn at different ears of the user is often referred to as a binaural hearing device.

When a hearing device is positioned at the intended wearing position at the ear of a user, for instance completely or partially inside an ear canal of the ear and/or at a concha of the ear and/or behind the ear, the user sometimes desires to influence an operation of the device. The operation may include to raise or lower a volume to a satisfactory level, switching to another hearing program, and/or accepting or declining a phone call. The desired operation may be executed directly by the respective hearing device or by a device operatively connected to the hearing device such as, for instance, a smartphone, a tablet, a computer, a television set, or the like.

Some examples of prior art solutions for a user interface allowing a manual user interaction for controlling such an operation include pushbuttons, rotary switches, toggle switches, or touchpads at an outer surface of the device. A manipulation of those control elements by the user, however, often poses problems inherently connected with a comparatively small size of the control element limited by the device size and/or the wearing position of the device at the ear not allowing a visual inspection of the device during the manipulation. Other prior art solutions employ an inertial sensor, such as an accelerometer, provided in the hearing device as a user interface. The accelerometer may be employed to detect a manual user interaction, for instance by detecting an acceleration of the hearing device caused by a manual impact on the hearing device or on the ear at the wearing position. The accelerometer may also be used to detect a user interaction based on another specific movement or movement pattern of the hearing device at the wearing position, for instance a movement caused by shaking or nodding of the user's head. Such a movement based user interaction, however, can rather easily provoke false activations of the operation by an accidental or inaccurate execution of the movement by the user, especially when a plurality of movement patterns are associated with different operations.

United States Patent Application Publication No. US 2020/0314521 A1 discloses a hearing device in which a manual tap or a double tap performed on the hearing device can be detected by an accelerometer in order to perform an operation based on the detected tap. Reliably identifying a manual tap based on a movement detected by an accelerometer may be realized by determining a tapping parameter that is significant for an individual user rather than a standardized tap parameter, as disclosed in US 2020/0314523 A1. The reliability may also be enhanced by employing a photodiode in addition to the accelerometer to detect the tap, as disclosed in US 2020/0314525 A1. However, it would be desirable to also allow an identification of a manual gesture different from a manual tap. Moreover, a further increase of the reliability of recognizing a manual gesture by a hearing device may be desirable.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION

Figure 1:
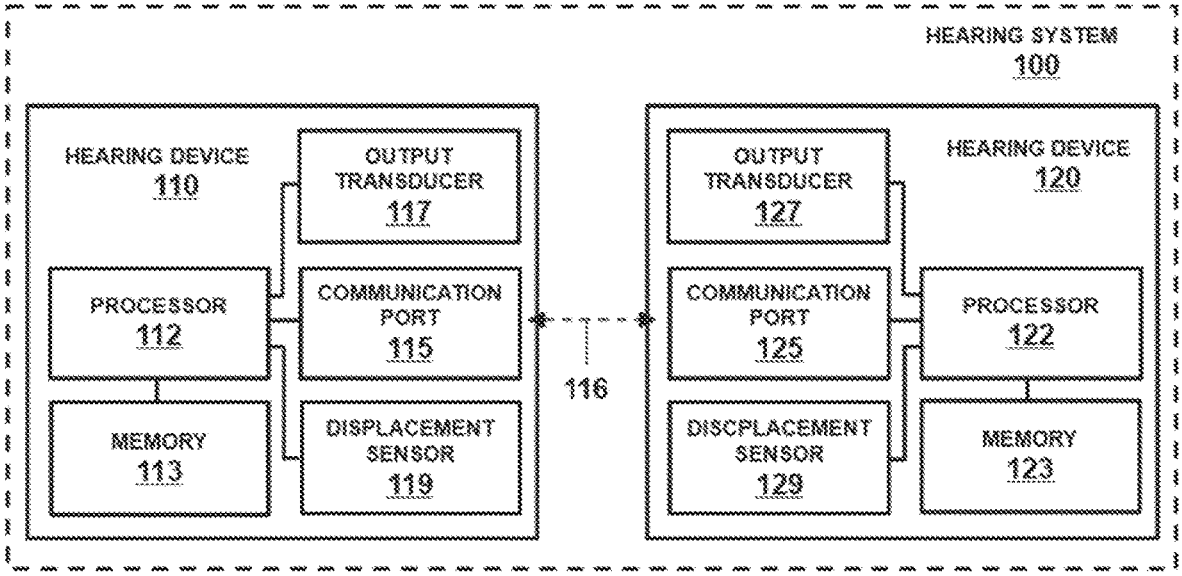
FIG. 1 schematically illustrates an exemplary hearing system comprising two hearing devices each configured to be worn at a respective ear of a user.

The disclosure relates to a hearing system comprising a first hearing device configured to be worn at a first ear of a user, and a second hearing device configured to be worn at a second ear of the user, both hearing devices comprising a displacement sensor configured to provide displacement data.

It is a feature of the present disclosure to avoid at least one of the above mentioned disadvantages and to equip a hearing system with a capability to identify a manual gesture in a reliable way, in particular to distinguish between a plurality of different manual gestures. It is another feature to enable a user to interact with the hearing system by a manual gesture in a rather intuitive way that can be easily memorized and/or reproduced by the user, in particular by a plurality of different manual gestures. It is a further feature to provide a convenient possibility for the user to control an operation of the hearing system such as, for example a volume control and/or toggling between different programs and/or accepting or declining an operation such as, for instance, an incoming phone call, and/or switching between a stand-by mode and a running mode. It is still another feature to allow a customization of the identification of a manual gesture to an individual user, in particular of a plurality of different manual gestures.

At least one of these features can be achieved by a hearing system as described herein.

Accordingly, the present disclosure proposes a hearing system comprising a first hearing device configured to be worn at a first ear of a user, the first hearing device comprising a first displacement sensor configured to provide first displacement data indicative of a rotational displacement and/or a translational displacement of the first hearing device; a second hearing device configured to be worn at a second ear of the user, the second hearing device comprising a second displacement sensor configured to provide second displacement data indicative of a rotational displacement and/or a translational displacement of the second hearing device; and a processing unit communicatively coupled to the first displacement sensor and to the second displacement sensor, wherein the processing unit is configured to determine, based on the first displacement data and the second displacement data, a variation measure indicative of a variation of an orientation of the first hearing device relative to an orientation of the second hearing device and/or a variation of a position of the first hearing device relative to a position of the second hearing device; to determine whether the variation measure matches a pattern characteristic for a manual gesture performed on the first hearing device and/or the second hearing device; and to control an operation of the hearing system when the variation measure matches the pattern.

In this way, a reliability of identifying a manual gesture performed by the user on the first hearing device and/or the second hearing device can be enhanced by employing the displacement data provided by the displacement sensor of each hearing device rather than only employing displacement data obtained by a single hearing device. In particular, the increased reliability can enable identification of a manual gesture that may be hard to determine based on single displacement data. The increased reliability can also enable identification of a plurality of different manual gestures that may be hard to distinguish based on single displacement data. For instance, an identification of a manual gesture that is particularly convenient for the user to carry out and/or to remember may thus be implemented. Moreover, a manual gesture that has been performed intentionally by the user may thus be distinguished from an accidental gesture.

Independently, the present disclosure proposes a method of operating a hearing system, the hearing system comprising a first hearing device configured to be worn at a first ear of a user, the first hearing device comprising a first displacement sensor configured to provide first displacement data indicative of a rotational displacement and/or a translational displacement of the first hearing device; and a second hearing device configured to be worn at a second ear of the user, the second hearing device comprising a second displacement sensor configured to provide second displacement data indicative of a rotational displacement and/or a translational displacement of the second hearing device, wherein the method comprises determining, based on the first displacement data and the second displacement data, a variation measure indicative of a variation of an orientation of the first hearing device relative to an orientation of the second hearing device and/or a variation of a position of the first hearing device relative to a position of the second hearing device; determining whether the variation matches a pattern characteristic for a manual gesture performed on the first hearing device and/or the second hearing device; and controlling an operation of the hearing system when the variation measure matches the pattern.

Independently, the present disclosure proposes a non-transitory computer-readable medium storing instructions that, when executed by a processing unit included in the hearing system, cause the processing unit to perform said method of operating a hearing system.

Subsequently, additional features of some implementations of the method and/or the method of operating a hearing system are described. Each of those features can be provided solely or in combination with at least another feature. The features can be correspondingly provided in some implementations of the hearing system and/or the method and/or the computer-readable medium.

In some implementations, the pattern is characteristic for at least one manual pressing on the first hearing device and/or the second hearing device; and/or at least one manual swiping on the first hearing device and/or the second hearing device; and/or at least one manual rotation of the first hearing device and/or the second hearing device. In some implementations, the first hearing device is configured to be at least partially inserted into an ear canal of the first ear and the second hearing device is configured to be at least partially inserted into an ear canal of the second ear, wherein the pattern is characteristic for at least one manual rotation of the first hearing device and/or the second hearing device around a central axis of the ear canal of the first ear and/or the second ear; and/or at least one manual pressing and/or at least one manual swiping on the first hearing device and/or the second hearing device causing a displacement of the first hearing device and/or the second hearing device along the central axis. Manual pressing may include, for instance, manual tapping, which may be characterized by a shorter period during which the manual pressing is performed and/or a manual long pressing, which may be characterized by a longer period during which the manual pressing is performed. The pattern may also be characteristic for at least two manual pressings and/or at least two manual swipings and/or at least two manual rotatings, which may be characterized by a maximum period in between the two manual gestures are performed in a sequence. The pattern may also be characteristic for a combination of those manual gestures.

In some implementations, the variation measure may be determined to match the pattern characteristic for the at least one manual rotating around the central axis of the ear canal and/or the pattern characteristic for the at least one manual pressing and/or at least one manual swiping causing the displacement along the central axis also when the variation measure is indicative of an additional variation of the orientation and/or position of the first hearing device relative to the second hearing device, for instance a variation caused by manual rotation around an axis perpendicular and/or at an angle to the ear canal axis and/or by a translational displacement perpendicular and/or at an angle to the ear canal axis in addition to the manual rotating around the central axis and/or the at least one manual pressing and/or at least one manual swiping causing the displacement along the central axis. In other implementations, the variation measure may only be determined to match the pattern characteristic for the at least one manual rotating around the central axis of the ear canal and/or the pattern characteristic for the at least one manual pressing and/or at least one manual swiping causing the displacement along the central axis when the variation measure does not indicate such an additional variation of the orientation and/or position of the first hearing device relative to the second hearing device.

In some implementations, the processing unit is configured to control an operation of the first hearing device and/or the second hearing device when the variation measure matches the pattern. The operation may be an operation optimized for the first hearing device and the second hearing device worn by a single user. In particular, the operation may be an operation optimized for the first hearing device being worn at a first ear of the user, and the second hearing device being worn at a second ear of the same user. Such an operation may be referred to as a binaural operation of the first hearing device and the second hearing device. An operation optimized for only one of the first hearing device and the second hearing device being worn at an ear of the user may be referred to as a monaural operation of the first hearing device and/or the second hearing device, for instance when the first hearing device is worn at an ear of a first user and the second hearing device is worn at an ear of a second user. In some implementations, the processing unit is configured to only control a binaural operation of the first hearing device and the second hearing device when the variation measure matches the pattern.

The controlling of the operation may comprise adjusting a parameter of an operation performed by the first hearing device and/or the second hearing device. For instance, the operation may include an audio output of the first hearing device and/or the second hearing device; and/or an audio processing executed by the processing unit; and/or a sensor data processing executed by the processing unit. Before and/or after the adjusting of the parameter of the operation, the parameter may be optimized for the first hearing device and the second hearing device worn by a single user. In particular, before and/or after the adjusting of the parameter of the operation, the parameter may be optimized for the operation of the first hearing device and the second hearing device when the first hearing device and the second hearing device are simultaneously worn by the user, for instance as compared to a parameter which would be optimized when only one of the first hearing device and second hearing device would be worn by the user and/or when the first hearing device and the second hearing device would be worn by different users. An operation in which, before and after the adjusting of the parameter of the operation, the parameter is optimized for the first hearing device and the second hearing device worn by a single user may be referred to as a binaural operation of the first hearing device and the second hearing device. An operation in which, before and after the adjusting of the parameter of the operation, the parameter is optimized for only one of the first hearing device and the second hearing device worn by a single user may be referred to as a monaural operation of the first hearing device or the second hearing device.

In some implementations, the controlling of the operation comprises adjusting an audio output of the first hearing device and/or the second hearing device, for instance a volume level; and/or adjusting a parameter of an audio processing program executed by the processing unit; and/or adjusting a parameter of a sensor data processing program executed by the processing unit; and/or toggling between different programs executed by the processing unit; and/or accepting and/or declining the operation, for instance an operation with respect to a phone call; and/or putting the operation into a stand by mode in which the operation is not further executed and/or restoring the operation from the stand by mode into a running mode in which the operation is further executed; and/or adjusting a power consumption of the first hearing device and/or the second hearing device; and/or rebooting an operation system and/or turning off the first hearing device and/or the second hearing device; and/or performing a communication between the first hearing device and the second hearing device, for instance a pairing operation between the hearing devices; and/or performing a communication between the first hearing device and/or the second hearing device and a remote device, for instance a pairing operation of at least one of the hearing devices with the remote device; and/or performing a communication of the hearing system, in particular the first hearing device and/or the second hearing device, with an external device. The external device may be any device that is not worn be the user and/or operated by the user. For instance, the external device may be a device of a service provider, such as a streaming service, and/or a device maintaining data, such as a data cloud, and/or any other computing device.

In some implementations, the processing unit is configured to determine an amount of the variation of the orientation of the first hearing device relative to the orientation of the second hearing device and/or an amount of the variation of the position of the first hearing device relative to the position of the second hearing device. The processing unit can be further configured to control the operation depending on the amount of the variation when the variation measure matches the pattern. The amount of the variation of the orientation of the first hearing device relative to the orientation of the second hearing device may comprise a degree to which the orientation of the first hearing device changes relative to the orientation of the second hearing device. The amount of the variation of the position of the first hearing device relative to the orientation of the second hearing device may comprise a relative change of a distance between the first hearing device and the second hearing device. For example, when the variation measure matches the pattern characteristic for the at least one manual rotation of the first hearing device and/or the second hearing device, the processing unit may be configured to determine the amount of the variation of the orientation of the first hearing device relative to the orientation of the second hearing device and to control the operation depending on the amount of the variation. The manual rotation of the first hearing device and/or the second hearing device, in particular around the central axis of the ear canal, may thus be employed to control the operation depending on the degree of the rotation. In particular, a volume level of an audio output of the first hearing device and/or the second hearing device, may thus be controlled depending on the degree of the rotation. A smaller degree of rotation may thus lead to a smaller increase or decrease of the volume level as compared to a larger degree of rotation leading to a larger increase or decrease of the volume level.

The variation measure may be indicative of a deviation between the first displacement data and the second displacement data. The deviation may be determined, for instance, by taking a difference between the first displacement data and the second displacement data and/or by determining a lack of correlation between the first displacement data and the second displacement data. In this way, influences on the displacement data unrelated the manual gesture, for instance movements of the user's head and/or body, may be removed. The pattern may define a minimum amount of said variation, in particular of the deviation between the first displacement data and the second displacement data, and/or a maximum amount of said variation, and/or a temporal characteristic of said variation. To illustrate, the minimum amount of said variation may be determined based on an amplitude and/or a slope of an amplitude of the variation measure exceeding a minimum threshold. The maximum amount may be determined based on the amplitude and/or slope of the amplitude not exceeding a maximum threshold. The temporal characteristic of the variation may be based on any feature and/or any temporal sequence of features of the variation measure characteristic for the manual gesture over time, for instance a minimum period and/or maximum period in between two subsequent features.

In some implementations, the processing unit is configured to determine, based on the first displacement data and the second displacement data, a variation of a difference between an orientation of the first hearing device and an orientation of the second hearing device; and/or a variation of a difference between a position of the first hearing device and a position of the second hearing device, and/or a variation of a distance between the first hearing device and the second hearing device, wherein the variation measure is indicative of the variation of said difference. The variation measure may thus comprise information that may be determined directly from a deviation between the first displacement data and the second displacement data.

In some implementations, the processing unit is configured to determine, based on the first displacement data and the second displacement data, a variation between an orientation of the first hearing device relative to a reference direction and an orientation of the second hearing device relative to the reference direction; and/or a variation between a position of the first hearing device relative to a reference position and a position of the second hearing device relative to the reference position, wherein the variation measure is indicative of the variation of the orientation and/or the position of the first hearing device and the second hearing device relative to the reference direction and/or the reference position. The variation measure may thus comprise information that may be determined indirectly from a deviation between the first displacement data and the second displacement data, for instance by relating the variation of the orientation and/or the position relative to the reference direction and/or the reference position of the first hearing device and the second hearing device to each other.

The variation measure may thus be indicative of a variation between an orientation of the first hearing device relative to a reference direction and an orientation of the second hearing device relative to the reference direction; and/or a variation of a difference between an orientation of the first hearing device and an orientation of the second hearing device; and/or a variation between a position of the first hearing device relative to a reference position and a position of the second hearing device relative to the reference position; and/or a variation of a distance between the first hearing device and the second hearing device. In some implementations, the variation measure is indicative of both the variation of said difference between the orientation and/or position of the first hearing device and the second hearing device, and the orientation and/or the position of the first hearing device and the second hearing device relative to the reference direction and/or the reference position.

The processing unit may be configured to determine the reference direction and/or the reference position before determining the variation measure. In some instances, the reference direction and/or the reference position can be determined by the processing unit in an initialization operation and/or in a resting state of the first hearing device worn at the first ear and the second hearing device worn at the second ear and/or in the absence of the manual gesture performed on the first hearing device and/or the second hearing device. In some instances, the reference direction can be provided as the direction of the gravitational force and/or the Earth's magnetic field.

In some implementations, the pattern is a first pattern characteristic for a first manual gesture, wherein the processing unit is configured to determine whether the variation measure matches a second pattern characteristic for a second manual gesture performed on the first hearing device and/or the second hearing device. In this way, the first manual gesture and the second manual gesture can be distinguished by the processing unit depending on whether the variation measure matches the first pattern or the second pattern. The second manual gesture may be different from the first manual gesture. The operation may be a first operation, wherein the processing unit is configured to control a second operation when the variation measure matches the second pattern. The second operation may be different from the first operation.

In some implementations, the pattern, in particular the first and/or second pattern, is characteristic for the at least one manual rotation of the first hearing device and/or the second hearing device, in particular around the central axis of the ear canal. The operation, in particular the first and/or second operation, may include controlling the adjusting the audio output of the first hearing device and/or the second hearing device and/or the adjusting a parameter of an audio processing program executed by the processing unit and/or the adjusting a parameter of a sensor data processing program executed by the processing unit. Adjusting the audio output may include changing the volume level of the audio output. In particular, a first direction of the rotation may be applied as the first operation to control an increase of the volume level and a second direction of the rotation, which may be opposed to the first direction, may be applied as the second operation to control a decrease of the volume level. A degree of the rotation may be applied to control an amount of the change of the volume level, in particular an amount of the increase or decrease of the volume level. A speed of the rotation may be applied to control a rate of the change of the volume level.

In some implementations, the pattern, in particular the first and/or second pattern, is characteristic for at least one manual pressing on the first hearing device and/or the second hearing device. The operation, in particular the first and/or second operation, may include the accepting and/or declining the operation and/or the putting the operation into the stand by mode and/or running mode and/or the adjusting the power consumption and/or the rebooting and/or turning off and/or the performing a communication. In some implementations, the pattern, in particular the first and/or second pattern, is characteristic for the at least one manual swiping on the first hearing device and/or the second hearing device. The operation, in particular the first and/or second operation, may include the toggling between different programs executed by the processing unit and/or the adjusting the audio output of the first hearing device and/or the second hearing device and/or the adjusting a parameter of an audio processing program executed by the processing unit and/or the adjusting a parameter of a sensor data processing program executed by the processing unit.

In some implementations, the first displacement sensor and/or the second displacement sensor comprises an inertial sensor and/or a magnetometer. The inertial sensor may comprise an accelerometer and/or a gyroscope. In some implementations, the first hearing device and/or the second hearing device further comprises an environmental sensor configured to provide environmental data indicative of a property of an ambient environment of the first hearing device and/or the second hearing device, wherein the processing unit is configured to determine the variation measure based on the environmental data in addition to the first displacement data and the second displacement data. The environmental sensor may comprise a capacitive sensor configured to provide capacitance data indicative of a capacitive coupling of the first hearing device and/or the second hearing device with an ambient environment; and/or a resistive sensor configured to provide resistance data indicative of an electrical resistance at an interface between the first hearing device and/or the second hearing device and the ambient environment; and/or a sound sensor configured to provide sound data indicative of sound detected in the ambient environment; and/or a light sensor configured to provide optical data indicative of light detected in the ambient environment; and/or a proximity sensor configured to provide proximity data indicative of a presence of an object in a proximity of the first hearing device and/or the second hearing device, wherein the environmental data comprises the capacitance data and/or the resistance data and/or the sound data and/or the optical data and/or the proximity data. For instance, the sound data may be indicative of a sound produced by performing the manual gesture.

In some implementations, the processing unit is configured to apply a Kalman filter and/or a machine learning algorithm on the variation measure when determining whether the variation measure matches the pattern. In some implementations, the processing unit is configured to apply a Kalman filter and/or a machine learning algorithm on the first displacement data and/or the second displacement data when determining the variation measure based on the first displacement data and the second displacement data.

In some implementations, the processing unit comprises a first processor included in the first hearing device configured to receive the first displacement data, and a second processor included in the second hearing device configured to receive the second displacement data, wherein the first processor and the second processor are communicatively coupled with each other. The processing unit may thus be configured to determine the variation measure based on the first displacement data received by the first processor and the second displacement data received by the second processor. In some implementations, the hearing system comprises a remote device configured to be worn and/or operated by the user remote from the first and second ear and configured to be communicatively coupled to the first hearing device and the second hearing device, wherein the processing unit includes a processor included in the remote device. The processor included in the remote device may be configured to receive the first and second displacement data.

FIG. 1 illustrates an exemplary hearing system 100 comprising a first hearing device 110 configured to be worn at a first ear of a user, and a second hearing device 120 configured to be worn at a second ear of the user. Hearing devices 110, 120 may each be implemented by any type of hearing device configured to enable or enhance hearing by a user wearing hearing device 110, 120. For example, hearing device 110, 120 may be implemented by a hearing aid configured to provide an audio content such as an amplified version of a detected ambient sound to a user, a sound processor included in a cochlear implant system configured to provide electrical stimulation representative of audio content to a user, a sound processor included in a bimodal hearing system configured to provide both amplification and electrical stimulation representative of audio content to a user, or any other suitable hearing prosthesis. As another example, hearing device 110, 120 may be implemented by an earbud or an earphone or a hearable configured to reproduce an audio content communicated by a wire or wirelessly to hearing device 110, 120 and/or to reproduce a detected ambient sound with or without altering the ambient sound and/or adding sound features to the ambient sound.

In the illustrated example, first hearing device 110 includes a processor 112 communicatively coupled to a memory 113, an output transducer 117, a communication port 115, and a displacement sensor 119. Further in this example, second hearing device 120 has a corresponding configuration including another processor 122 communicatively coupled to another memory 123, another output transducer 127, another communication port 125, and another displacement sensor 129. A processing unit includes processors 112 of first hearing device 110 and processor 122 of second hearing device 120. Other configurations are conceivable in which, for instance, processor 112, 122 is only provided in one of hearing devices 110, 120 such that the processing unit includes only one of the processors. Hearing devices 110, 120 may include additional or alternative components as may serve a particular implementation.

Output transducer 117, 127 may be implemented by any suitable audio transducer configured to output an audio signal to the user, for instance a receiver of a hearing aid, an output electrode of a cochlear implant system, or a loudspeaker of an earbud. The audio transducer may be implemented as an acoustic transducer configured to generate sound waves when outputting the audio signal. Output transducer 117 of first hearing device 110 is subsequently referred to as a first output transducer. Output transducer 127 of second hearing device 120 is subsequently referred to as a second output transducer.

Displacement sensor 119, 129 may be implemented by any suitable detector configured to provide displacement data indicative of a rotational displacement and/or a translational displacement of hearing device 110, 120 in which displacement sensor 119, 129 is included. In particular, displacement sensor 119, 129 may comprise at least one inertial sensor. The inertial sensor can include, for instance, an accelerometer configured to provide the displacement data representative of an acceleration and/or a translational movement and/or a rotation, and/or a gyroscope configured to provide the displacement data representative of a rotation. Displacement sensor 119, 129 may also comprise an optical detector such as a light sensor and/or a camera. The optical detector may be configured to detect light at a specific wavelength and/or at a plurality of different wavelengths. Examples include a charged-coupled-device (CCD) sensor, a photodetector sensitive for light in the red and/or infrared electromagnetic spectrum, a photoplethysmography (PPG) sensor, a pulse oximeter including a photodetector for determining an oxygen saturation ($SpO_2$ level) of the user's blood, and/or the like. In some instances, the optical detector may be implemented to be disposed inside the ear canal and/or at the concha of the ear when the hearing device is worn at the ear. The displacement data may be provided by generating optical detection data over time and evaluating variations of the optical detection data. Displacement sensor 119, 129 may also comprise an electronic compass such as a magnetometer configured to provide the displacement data representative of a change of a magnet field, in particular a magnetic field in an ambient environment of hearing device 110, 120 such as the Earth's magnetic field. Displacement sensor 119, 129 may also be implemented by any combination of the above mentioned sensors and/or a plurality of the above mentioned sensor. In some instances, the data provided by the sensors may be combined in the first displacement data and/or the second displacement data, in particular after processing of the data and/or without data processing. For instance, a magnetometer may be combined with an accelerometer and/or a gyroscope.

Displacement sensor 119, 129 may be configured to provide the displacement data continuously over time in subsequent periods. Displacement sensor 119, 129 may be mechanically coupled to a housing of hearing device 110, 120 such that it remains in a fixed position relative to the housing upon a translational and/or rotational displacement of the housing. Thus, the displacement data provided by displacement sensor 119, 129 can be indicative of a rotational displacement and/or a translational displacement of the housing. Displacement sensor 119 of first hearing device 110 is subsequently referred to as a first displacement sensor configured to provide first displacement data. Displacement sensor 129 of second hearing device 120 is subsequently referred to as a second displacement sensor configured to provide second displacement data.

Communication port 115, 125 may be implemented by any suitable data transmitter and/or data receiver and/or data transducer configured to exchange data between first hearing device 110 and second hearing device 120 via a communication link 116. Communication port 115, 125 may be configured for wired and/or wireless data communication. In particular, data may be exchanged wirelessly via communication link 116 by radio frequency (RF) communication. For instance, data may be communicated in accordance with a Bluetooth™ protocol and/or by any other type of RF communication such as, for example, data communication via an internet connection and/or a mobile phone connection. Examples may include data transmission within a frequency band including 2.4 GHz and/or 5 GHz and/or via a 5G broadband cellular network and/or within a high band spectrum (HiBan) which may include frequencies above 20 GHz. Data may also be exchanged wirelessly via communication link 116 through the user's skin, in particular by employing skin conductance between the positions at which hearing devices 110, 120 are worn.

The communicated data may comprise the displacement data provided by displacement sensor 119, 129. The communicated data may also comprise data processed by processing unit 112, 122, in particular displacement data processed by processing unit 112, 122, and/or data maintained in memory 113, 123, in particular displacement data maintained in memory 113, 123. The communicated data may be selected by processing unit 112, 122 and/or the data exchange between hearing devices 110, 120 may be controlled by processing unit 112, 122. For instance, processing unit 112, 122 may be configured to coordinate the data exchange between communication ports 115, 125 by controlling a pairing and/or handshaking operation between hearing devices 110, 120 and/or the like. Communication port 115 of first hearing device 110 is subsequently referred to as a first communication port. Communication port 125 of second hearing device 120 is subsequently referred to as a second communication port.

Memory 113, 123 may be implemented by any suitable type of storage medium and is configured to maintain, e.g. store, data controlled by processing unit 112, 122, in particular data generated, accessed, modified and/or otherwise used by processing unit 112, 122. For example, processing unit 112, 122 may control memory 113, 123 to maintain data. The maintained data may include a database comprising data representative of at least one pattern characteristic for a manual gesture performed on first hearing device 110 and/or second hearing device 120. The maintained data may also include a data record of data representative of the first displacement data and/or second displacement data provided by displacement sensor 119, 129. Memory 113, 123 may also be configured to store instructions for operating hearing system 100 that can be executed by processing unit 112, 122, in particular an algorithm and/or a software that can be accessed and executed by processing unit 112, 122.

Memory 113, 123 may comprise a non-volatile memory from which the maintained data may be retrieved even after having been power cycled, for instance a flash memory and/or a read only memory (ROM) chip such as an electrically erasable programmable ROM (EEPROM). A non-transitory computer-readable medium may thus be implemented by memory 113, 123. Memory 113, 123 may further comprise a volatile memory, for instance a static or dynamic random access memory (RAM). A memory unit includes memory 113 of first hearing device 110 and memory 123 of second hearing device 120. Other configurations are conceivable in which memory 113, 123 is only provided in one of hearing devices 110, 120 such that the memory unit includes only one of the memories. Memory 113 of first hearing device 110 is subsequently referred to as a first memory. Memory 123 of second hearing device 120 is subsequently referred to as a second memory.

Processing unit 112, 122 is configured to access the first displacement data provided by first displacement sensor 119, and the second displacement data provided by second displacement sensor 129. Processing unit 112, 122 is further configured to determine, based on the first displacement data and the second displacement data, a variation measure indicative of a variation of an orientation of first hearing device 110 relative to an orientation of second hearing device 120 and/or a variation of a position of first hearing device 110 relative to a position of second hearing device 120. Processing unit 112, 122 is further configured to determine whether the variation measure matches a pattern characteristic for a manual gesture performed on first hearing device 110 and/or second hearing device 120. In particular, data representative of the characteristic pattern may be retrieved by processing unit 112, 122 from a database, for instance from memory unit 113, 123 and/or from an external data base which may be accessed via another communication port which may be provided in addition to communication ports 115, 125. Processing unit 112, 122 may be further configured to control an operation of hearing system 100 when the variation measure matches the pattern. These and other operations, which may be performed by processing unit 112, 122, are described in more detail in the description that follows.

In the illustrated example, processing unit 112, 122 comprises processor 112 of first hearing device 110 subsequently referred to as a first processor, and processor 122 of second hearing device 120 subsequently referred to as a second processor. In some implementations, each of the above described operations can be performed independently by at least one of processor 112 and processor 122 of the processing unit. In some implementations, those operations can be shared between processors 112 and processor 122. For instance, at least one of the operations may be performed by one of processors 112, 122, and the remaining operations may be performed by the other of processors 112, 122. In some implementations, at least one those operations can be performed jointly by processor 112 and processor 122, for instance by performing different tasks of the operation. Processing unit 112, 122 may be implemented, for instance, as a distributed processing system of processors 112, 122 and/or in a master/slave configuration of processors 112, 122. In some other implementations, the processing unit configured to perform those operations consists of processor 112 included in first hearing device 110 or processor 122 included in second hearing device 120.

First hearing device 110 and/or second hearing device 120 may further comprise a sound sensor. The sound sensor may be implemented by any suitable audio detection device configured to detect a sound in an ambient environment of the user and/or inside the ear-canal and to provide sound data representative of the detected sound, in particular a microphone and/or a microphone array and/or a VAD and/or a speaker recognition detector and/or a speech type detector and/or a body sound detector. The sound can comprise ambient sound such as audio content (e.g., music, speech, noise, etc.) generated by one or more sound sources included in an environment of the user. The sound can also include audio content generated by a voice of the user during an own voice activity, such as a speech by the user. The sound sensor can be configured to provide audio data comprising information about the detected sound to processing unit 112, 122.

First hearing device 110 and/or second hearing device 120 may further comprise a biometric sensor. The biometric sensor may be implemented by any suitable detection device configured to detect a biological characteristic intrinsic to a living organism, in particular a human body, and to provide biometric data indicative of the biological characteristic. The biometric sensor may be configured to provide an acute measurement of the biological characteristic, for instance by directly detecting energy and/or matter from the living organism, and/or a processed collection of acute measurements of the biological characteristic. In some examples, the biometric sensor comprises a photoplethysmography (PPG) sensor and/or an electrocardiography (ECG) sensor and/or an electroencephalography (EEG) sensor and/or an electrooculography (EOG) sensor and/or a temperature sensor and/or a skin conductance sensor and/or a RF sensor and/or a pupillometry sensor and/or a pulse oximeter, and/or the like. The biometric sensor may also be implemented by any combination and/or a plurality of those sensors. The biometric sensor can be configured to provide biometric data comprising information about the detected biological characteristic to processing unit 112, 122. In some instances, as described above, the biometric sensor may be employed as displacement sensor 119, 129 to provide the displacement data.

First hearing device 110 and/or second hearing device 120 may further comprise an environmental sensor. The environmental sensor may be implemented by any suitable detection device configured to detect a characteristic of an ambient environment of hearing device 110, 120. In some implementations, the environmental sensor may be configured to provide environmental data indicative of a characteristic of the ambient environment which may be influenced by a manual interaction of the user, in particular by a manual gesture carried out by the user in the ambient environment and/or on hearing device 110, 120. The environmental sensor may comprise a capacitive sensor configured to provide capacitance data indicative of a capacitive coupling of the first hearing device and/or the second hearing device with the ambient environment. The environmental sensor may comprise a resistive sensor configured to provide resistance data indicative of an electrical resistance at an interface between the first hearing device and/or the second hearing device and the ambient environment. The environmental sensor may comprise a light sensor, for instance a photodiode and/or a camera, configured to provide optical data indicative of light detected in the ambient environment, in particular a variation of incident light caused by a manual gesture performed on hearing device 110, 120. The environmental sensor may comprise a sound sensor, for instance the sound sensor described above, configured to provide sound data indicative of sound detected in the ambient environment, in particular a sound caused by a manual gesture performed on hearing device 110, 120. The environmental sensor may comprise a proximity sensor configured to provide proximity data indicative of a presence of an object in a proximity of the first hearing device and/or the second hearing device. The environmental sensor may also be implemented by any combination of the above mentioned sensors and/or a plurality of the above mentioned sensors. In some instances, the data provided by the sensors may be combined in the environmental data, in particular after processing of the data and/or without data processing. For instance, a first proximity sensor may be implemented to be placed inside the ear canal, and a second displacement sensor may be implemented to be placed at the concha of the ear when the hearing device is worn by the user in order to determine whether the hearing device is placed inside the ear canal, in particular at a specific location of the ear canal.

The environmental data provided by the environmental sensor may thus comprise capacitance data and/or resistance data and/or optical data and/or sound data and/or proximity data which can be indicative of a manual gesture performed on hearing device 110, 120. Processing unit 112, 122 can be configured to receive the environmental data from the environmental sensor. In some implementations, processing unit 112, 122 is configured to determine the variation measure based on the environmental data in addition to the first displacement data and the second displacement data. In this way, a reliability of determining whether the variation measure matches a pattern characteristic for a manual gesture performed on the first hearing device and/or the second hearing device may be further enhanced.

First hearing device 110 and/or second hearing device 120 may include any combination of the plethora of the sensors described above and/or a plurality of those sensors.

First hearing device 110 and/or second hearing device 120 may further comprise a user interface. The user interface may allow the user to provide processing unit 112, 122 with data and/or information, in particular data and/or information related to a controlling of hearing system 100 by processing unit 112, 122. The user interface may comprise a surface of first hearing device 110 and/or second hearing device 120, for example a housing of first hearing device 110 and/or second hearing device 120. A manual interaction of the user with the user interface, for instance by a manual gesture, can cause a displacement of first hearing device 110 and/or second hearing device 120 detectable by displacement sensor 119, 129 which thus can provide displacement data indicative of the manual interaction. The displacement data may thus be employed to determine an input from the user.

The user interface may also comprise at least one additional user interaction detector configured to determine a user input based on a user interaction, which may comprise a manual user interaction. The additional user interaction detector may include an environmental sensor. Environmental data provided by the environmental sensor may be employed to determine the variation measure in conjunction with the displacement data provided by displacement sensors 119, 129 in order to determine whether a manual gesture has been performed by the user, as described above, and/or the environmental data may be employed independently from the displacement data to determine a user input different from the manual gesture determined by the displacement data. The additional user interaction detector may also include a user input device such as, for instance, a pushbutton, a rotary switch, a toggle switch, a touchpad, a scrolling wheel, and/or the like.

Different types of hearing device 110, 120 can also be distinguished by the position at which they are worn at the ear. Some hearing devices, such as behind-the-ear (BTE) hearing aids and receiver-in-the-canal (RIC) hearing aids, typically comprise an earpiece configured to be at least partially inserted into an ear canal of the ear, and an additional housing configured to be worn at a wearing position outside the ear canal, in particular behind the ear of the user. Some other hearing devices, as for instance earbuds, earphones, hearables, in-the-ear (ITE) hearing aids, invisible-in-the-canal (IIC) hearing aids, and completely-in-the-canal (CIC) hearing aids, commonly comprise such an earpiece to be worn at least partially inside the ear canal without an additional housing for wearing at the different ear position.

Figure 2:
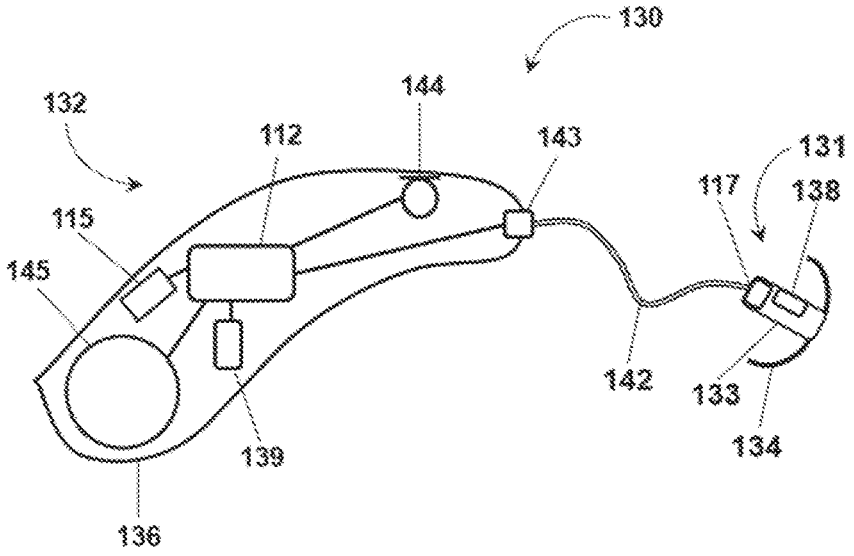
FIG. 2 schematically illustrates some embodiments of a hearing device of the hearing system illustrated in FIG. 1 in the form of a RIC hearing aid in a longitudinal sectional view.

FIG. 2 illustrates an exemplary implementation of first hearing device 110 as a RIC hearing aid 130, in accordance with some embodiments of the present disclosure. Second hearing device 120 may be correspondingly implemented. RIC hearing aid 130 comprises a BTE part 132 configured to be worn at an ear at a wearing position behind the ear, and an ITE part 131 configured to be worn at the ear at a wearing position at least partially inside an ear canal of the ear.

ITE part 131 is an earpiece comprising an ITE housing 133 at least partially insertable in the ear canal. A user may perform a manual gesture on housing 133, in particular a portion of housing 133 at an entrance of the ear canal and/or a portion of housing 133 ranging out of the ear canal, which can cause a rotational displacement and/or a translational displacement of housing 133 inside the ear canal. Housing 133 encloses output transducer 107 and a displacement sensor 138, which may be employed in the place of displacement sensor 119 of first hearing device 110 illustrated in FIG. 1. Displacement sensor 138 can thus provide displacement data indicative of the rotational and/or translational displacement of housing 133. Housing 133 may further comprise a flexible member 134 adapted to contact an ear canal wall when housing 133 is at least partially inserted into the ear canal. An acoustical seal with the ear canal wall may thus be provided at the housing portion contacting the ear canal wall. The acoustic seal may at least partially block ambient sound from entering the ear canal.

BTE part 132 comprises a BTE housing 136 configured to be worn behind the ear. A user may perform a manual gesture on housing 136 which can cause a rotational and/or translational displacement of housing 136 behind the ear. Second housing 136 accommodates processor 112 communicatively coupled to communication port 115 and a displacement sensor 139. Displacement sensor 139 of BTE part 132 may also be employed in the place of displacement sensor 119 of first hearing device 110 illustrated in FIG. 1. Displacement sensor 139 can thus provide displacement data indicative of the rotational and/or translational displacement of housing 136. In particular, displacement sensor 138 of ITE part 131 and displacement sensor 139 of BTE part 132 may both be employed in the place of displacement sensor 119.

BTE part 132 and ITE part 131 are interconnected by a cable 142. Processor 112 is communicatively coupled to output transducer 107 and displacement sensor 138 of ITE part 131 via cable 142 and a cable connector 143 provided at BTE housing 136. Processor 112 can thus be configured to receive displacement data from displacement sensor 138 of ITE part 131 and displacement sensor 139 of BTE part 132. Processor 112 can also be configured to receive displacement data provided by corresponding displacement sensors 138, 139 which may be implemented in second hearing device 120 in the place of displacement sensor 129 via communication port 115. BTE part 132 may further include a sound sensor 144 communicatively coupled to processor 112. BTE part 132 may further include a battery 145 as a power source for the above described components.

Figure 3:
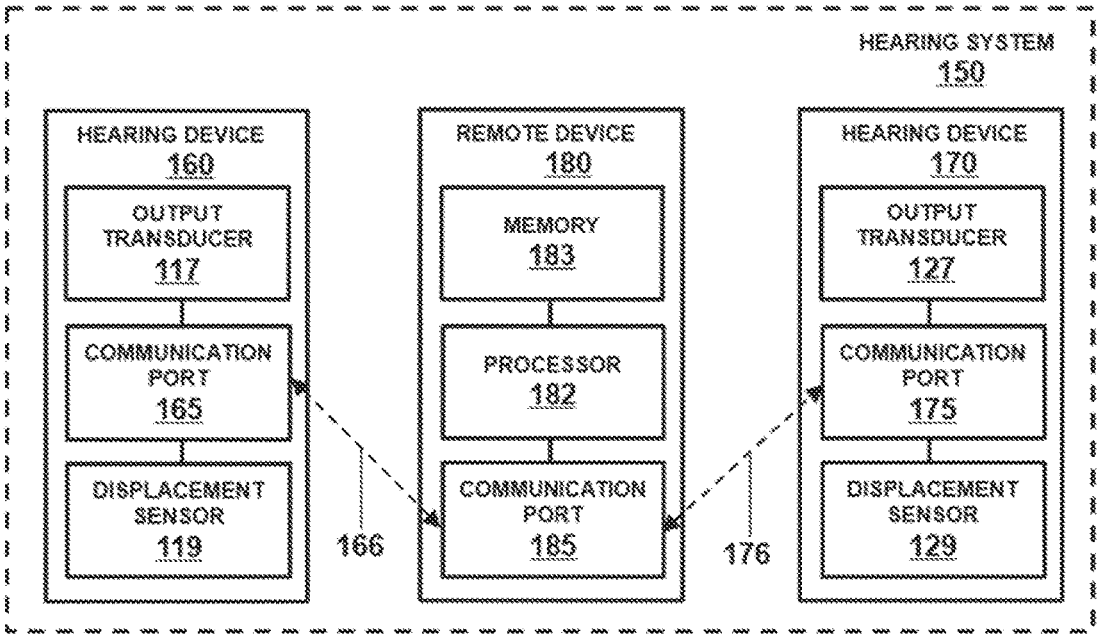
FIG. 3 schematically illustrates another exemplary hearing system comprising two hearing devices each configured to be worn at a respective ear of a user, and a remote device communicatively coupled to the hearing devices.

FIG. 3 illustrates another exemplary hearing system 150 comprising a first hearing device 160 configured to be worn at a first ear of a user, a second hearing device 170 configured to be worn at a second ear of the user, and a remote device 180 configured to be operated remote from the ears of the user. Hearing devices 160, 170 may each be implemented by any type of hearing device, for instance in accordance with hearing device 110, 120 described above. Remote device 180 may be an electronic device portable and/or wearable by the user. In particular, remote device 180 may be implemented as a communication device such as a smartphone, a smartwatch, a tablet and/or the like.

As illustrated, first hearing device 160 includes a communication port 165 communicatively coupled to output transducer 117 and displacement sensor 119. Second hearing device 170 includes a communication port 175 communicatively coupled to output transducer 127 and displacement sensor 129. Remote device 180 includes a processor 182 communicatively coupled to a memory 183 and a communication port 185. Memory 183 may be implemented by any suitable type of storage medium and is configured to maintain data controlled by processor 182, for instance corresponding to memory 113, 123 described above. Communication ports 165, 175, 185 may be implemented by any suitable data transmitter and/or data receiver and/or data transducer configured to exchange data between first hearing device 160 and remote device 180 via a first communication link 166 and to exchange data between second hearing device 170 and remote device 180 via a second communication link 176, for instance corresponding to communication ports 115, 125 described above. Communication port 165 of first hearing device 160 is subsequently referred to as a first remote communication port. Communication port 175 of second hearing device 170 is subsequently referred to as a second remote communication port. The data communicated from first hearing device 160 to remote device 180 can comprise the first displacement data provided by first displacement sensor 119, and the data communicated from second hearing device 170 to remote device 180 can comprise the displacement data provided by second displacement sensor 129. Processor 182 of remote device 180 can constitute a processing unit configured determine the variation measure based on the first displacement data and the second displacement data.

In some implementations, first hearing device 160 further includes first processor 112 and/or first memory 113. First processor 112 may be communicatively coupled to displacement sensor 119 and/or communication port 165 and/or output transducer 117. Second hearing device 170 may further include second processor 122 and/or second memory 123. Second processor 122 may be communicatively coupled to displacement sensor 129 and/or communication port 175 and/or output transducer 127. A processing unit configured to determine the variation measure based on the first displacement data and the second displacement data may thus comprise first processor 112 and/or second processor 122 and/or processor 182 of remote device 180. In some implementations, first hearing device 160 further includes first communication port 115 and second hearing device 170 further includes second communication port 125. The displacement data provided by displacement sensors 119, 129 may thus also be communicated between first hearing device 160 and second hearing device 170 via communication link 116. First hearing device 160 and/or second hearing device 170 may further include a sound sensor and/or a biometric sensor and/or an environmental sensor and/or a user interface, as described above.

Figure 4:
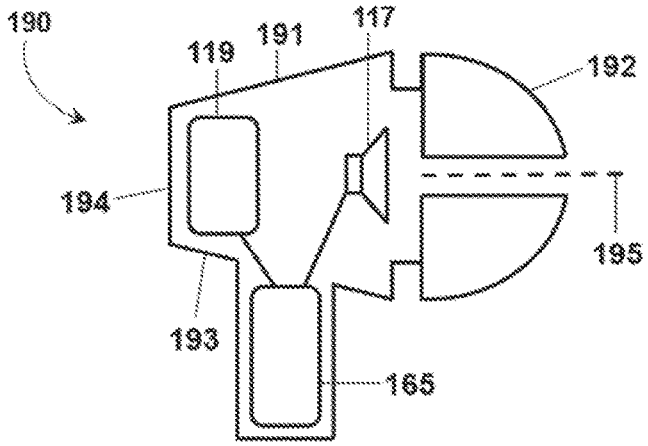
FIG. 4 schematically illustrates some embodiments of a hearing device of the hearing system illustrated in FIG. 3 in the form of an earbud in a longitudinal sectional view.

FIG. 4 illustrates an exemplary implementation of first hearing device 160 as an earbud 190, in accordance with some embodiments of the present disclosure. Second hearing device 170 may be correspondingly implemented. Earbud 190 is configured to be worn at the ear at a wearing position at least partially inside an ear canal of the ear. Earbud 190 comprises a housing 191 configured to be inserted into the ear canal such that a front portion 192 of housing 191 is positioned inside the ear canal and a rear portion 193 of housing 191 protrudes from the ear canal. When inserted into the ear canal, housing 191 longitudinally extends along a central axis 195 of the ear canal. A user may perform a manual gesture on rear portion 193 of housing 191 which can cause a rotational displacement and/or a translational displacement of housing 191 inside the ear canal. For instance, the user may tap on a rear wall 194 of rear portion 193 of housing 191 to effectuate a translational displacement of housing 191 deeper into the ear canal and/or rotate housing 191 around central axis 195 of the ear canal. Housing 191 encloses communication port 165, output transducer 117, and displacement sensor 119. Displacement sensor 119 can thus provide displacement data indicative of the rotational and/or translational displacement of housing 191. In some other examples, first hearing device 160 and/or second hearing device 170 of hearing system 150 may be implemented as RIC hearing aid 130 as illustrated in FIG. 2.

Figure 5:
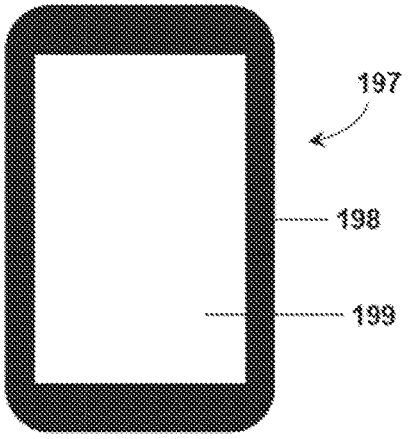
FIG. 5 schematically illustrates some embodiments of a remote device of the hearing system illustrated in FIG. 3 in the form of a communication device in a front view.

FIG. 5 illustrates an exemplary implementation of remote device 180 as a portable and/or wearable communication device 197, in accordance with some embodiments of the present disclosure. Communication device 197 comprises a housing 198 configured to be portable by the user, in particular to be worn by the user on the user's body, at a position remote from the ears at which hearing device 110, 120, 160, 170 is worn. For example, communication device 197 may be implemented as a smartphone, a tablet, a smartwatch, and/or the like. Communication device 197 further comprises a screen 199 configured to display information to the user and/or as a touchscreen operable as a user interface.

Figure 6:
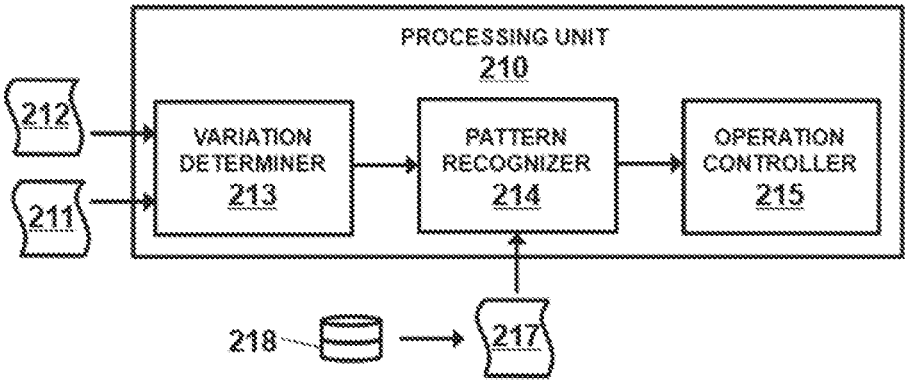
FIG. 6 schematically illustrates some exemplary configurations of the hearing system illustrated in FIGS. 1, 3 to determine, based on first and second displacement data, a variation measure, to determine whether the variation measure matches a pattern characteristic for a manual gesture, and to control an operation depending thereon.

FIG. 6 illustrates a functional block diagram of an exemplary sensor data processing algorithm that may be executed by a processing unit 210. Processing unit 210 may comprise processor 112 of hearing device 110 and/or processor 122 of hearing device 120 and/or processor 180 of remote device 180. As shown, the algorithm is configured to be applied to first displacement data 211 indicative of a rotational displacement and/or a translational displacement of first hearing device 110, 160 and second displacement data 212 indicative of a rotational displacement and/or a translational displacement of second hearing device 120, 170. First displacement data 211 and second displacement data 212 is inputted to processing unit 210. The algorithm comprises a variation measure determining module 213, a pattern recognizing module 214, and an operation controlling module 215.

Variation measure determining module 213 can determine, based on first displacement data 211 and second displacement data 212, a variation measure indicative of a variation of an orientation of first hearing device 110, 160 relative to an orientation of second hearing device 120, 170 and/or a variation of a position of first hearing device 110, 160 relative to a position of second hearing device 120, 170. In some instances, the variation measure can be determined to be indicative of a deviation between first displacement data 211 and second displacement data 212. For example, the variation measure may be determined directly from first displacement data 211 and second displacement data 212 by comparing first displacement data 211 and second displacement data 212 in order to determine the deviation. In some instances, the variation measure can be determined to be indicative of a variation of the orientation and/or the position of first hearing device 110, 160 and second hearing device 120, 170 relative to a reference direction and/or a reference position. For example, the variation measure may be determined indirectly from first displacement data 211 and second displacement data 212 by first determining a variation between an orientation of first hearing device 110, 160 relative to the reference direction and an orientation of second hearing device 120, 170 relative to the reference direction, and by secondly determining the variation of the orientation of first hearing device 110, 160 and second hearing device 120, 170 with respect to each other from their orientation variation relative to the reference direction. Correspondingly, the variation measure may also be determined indirectly from first displacement data 211 and second displacement data 212 by first determining a variation between a position of first hearing device 110, 160 relative to the reference position and a position of second hearing device 120, 170 relative to the reference position, and by secondly determining the variation of the position of first hearing device 110, 160 and second hearing device 120, 170 with respect to each other from their position variation relative to the reference position. In some instances, the variation measure can be determined to be indicative of both a deviation between first displacement data 211 and second displacement data 212, and a variation of the orientation and/or the position of first hearing device 110, 160 and second hearing device 120, 170 relative to the reference direction and/or the reference position. This may allow to determine the variation measure with an increased accuracy and/or reliability.

Pattern recognizing module 214 can determine whether the variation measure matches a pattern characteristic for a manual gesture performed on first hearing device 110, 160 and/or second hearing device 120, 170. The pattern may be based on data 217 associated with the manual gesture. Pattern data 217 may be retrieved by processing unit 210 from a database 218 before the determining whether the variation measure matches the pattern. Database 218 may be maintained in memory 113 of first hearing device 110, 160 and/or memory 123 of second hearing device 120, 170 and/or memory 183 of remote device 180. Database 218 may also be maintained in a storage unit external from hearing system 100, 150, for instance in a cloud, which may be accessed by processing unit 210 via a communication port included in first hearing device 110, 160 and/or second hearing device 120, 170 and/or remote device 180. Database 218 may include multiple pattern data 217 each associated with a different manual gesture. Processing unit 210 may be configured to retrieve at least one and/or a plurality of the multiple pattern data 217. Processing unit 210 can thus be configured to determine whether the variation measure matches at least one pattern characteristic of a manual gesture out of a plurality of patterns characteristic of different manual gestures. Pattern data 217 may comprise at least one predetermined value of the variation measure characteristic for the manual gesture performed on the first hearing device and/or the second hearing device and/or an algorithm executable by processing unit 210 to determine whether the variation measure matches the pattern. In some implementations, the algorithm may be based on a statistical estimation and/or a probability estimation whether the variation measure matches the pattern. For instance, the algorithm may include a Kalman filter and/or a trained machine learning (ML) algorithm. In some instances, in particular when the variation measure is determined to be indicative of a deviation between first displacement data 211 and second displacement data 212, the pattern may define a minimum amount of the deviation and/or a temporal characteristic of the deviation. In some instances, in particular when the variation measure is determined to be indicative of a variation of the orientation and/or the position of first hearing device 110, 160 and second hearing device 120, 170 relative to the reference direction and/or the reference position, the pattern may define a minimum amount and/or a temporal characteristic of the variation relative to the reference direction and/or the reference position.

To illustrate, pattern recognizing module 214 may determine in the above described way whether a physical interaction by a manual gesture has been performed on one of the first hearing device 110, 160 or the second hearing device 120, 170, in particular in the absence of a corresponding interaction on the other of the first hearing device 110, 160 or the second hearing device 120, 170. In particular, by determining whether the variation measure matches the pattern characteristic for a manual gesture, pattern recognizing module 214 can be configured to discriminate between a movement of hearing device 110, 160 intentionally carried out by the user by the manual gesture, and a movement of hearing device 110, 160 not intentionally carried out by the user, for instance hearing device 110, 160 being unintentionally dropped by the user and falling to the floor. To this end, features of the movement data, which may be indicative, for instance, a speed and/or acceleration of the hearing device caused by the manual gesture, may be characterized by the pattern in order to allow such a distinction. The pattern characteristic for a manual gesture may also account for a different timing and/or jitter of first displacement data 211 and second displacement data 212 when provided by displacement sensors 119, 129 and/or when communicated via communication ports 115, 125, 165, 175, 185.

In some instances, operation controlling module 215 can control an operation of hearing system 100, 150 depending on whether the variation measure matches the pattern. The operation may comprise an operation of at least one of first hearing device 110, 160 and second hearing device 120, 170 and/or an operation of remote device 180. Some examples of the controlling of the operation include, but are not limited to, adjusting an audio output of first hearing device 110, 160 and/or second hearing device 120, 170; adjusting a parameter of an audio processing program executed by processing unit 210; adjusting a parameter of a sensor data processing program executed by processing unit 210; toggling between different programs executed by the processing unit 210; accepting and/or declining the operation; putting the operation into a stand by mode and/or restoring the operation from the stand by mode into a running mode; adjusting a power consumption; rebooting an operation system run by processing unit 210; turning off first hearing device 110, 160 and/or second hearing device 120, 170; performing a communication, for instance a communication between first hearing device 110, 160 and/or second hearing device 120, 170 and/or remote device 180 and/or a device external from hearing system 100, 150 such as a device and/or a data provider distant from the user.

In some instances, operation controlling module 215 can control an operation of a remote device and/or any device external from the hearing system 100, 150, in particular a device which may or may not be related to a functionality of hearing system 100, 150 depending on whether the variation measure matches the pattern. Examples include raising and/or lowering of doors and/or controlling a robot and/or modifying a playlist. In some instances, operation controlling module 215 can also be configured to control an operation when the variation measure does not match the pattern characteristic for a manual gesture but matches a pattern characteristic for another displacement. For instance, the variation measure matching a pattern characteristic for the hearing device falling may be determined by pattern recognizing module 214. Operation controlling module 215 may then control, for instance, a pause of a data transmission to the hearing device, for example a music stream, and/or outputting of an alert to the user.

Figure 7A:
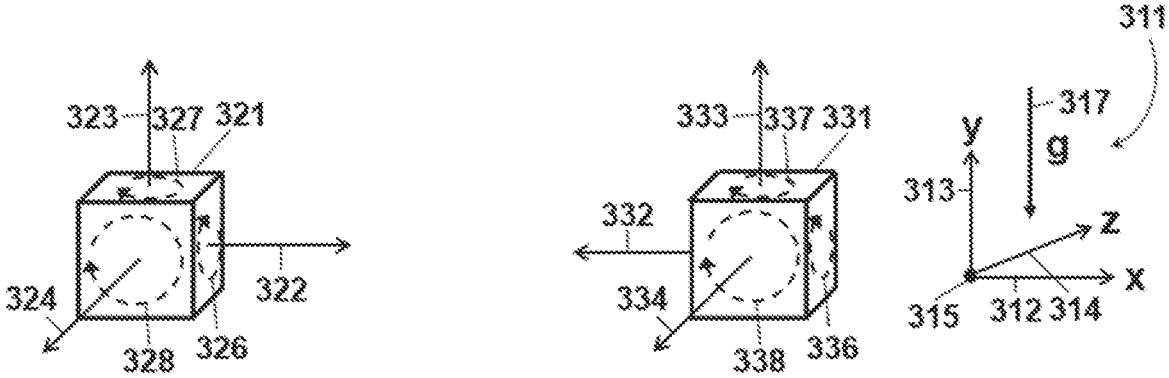
FIGS. 7A, B schematically illustrate some exemplary configurations of a first hearing device and a second hearing device before and after a displacement of the first hearing device by a manual gesture.
Figure 7B:
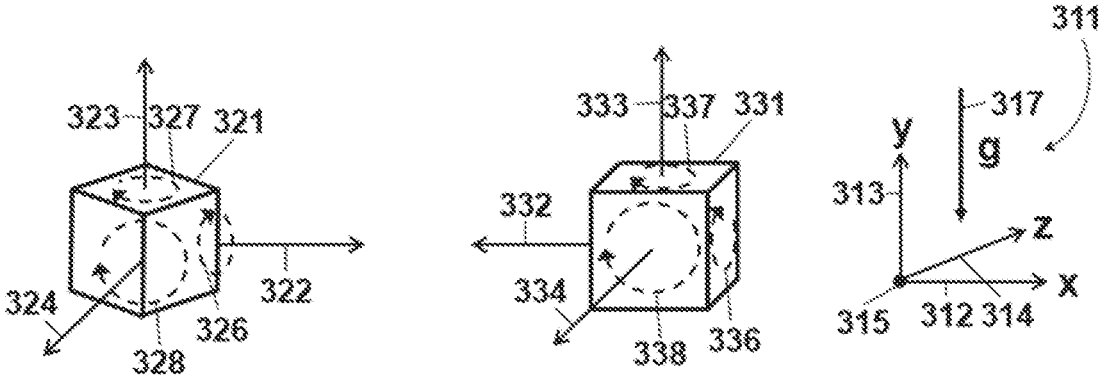

FIG. 7A and FIG. 7B illustrate some exemplary geometrical configurations of a hearing system comprising a first hearing device 321 configured to be worn at a first ear of a user and a second hearing device 331 configured to be worn at a second ear of the user at a wearing position outside of the ear canal. For instance, hearing devices 321, 331 may be implemented as BTE part 132 of first hearing device 110, 160 and BTE part 132 of second hearing device 120, 170. Furthermore, a coordinate system 311 is illustrated which may serve as a reference coordinate system for a rotational and/or translational displacement of first hearing device 321 and second hearing device 331. In some instances, reference coordinate system 311 can be selected to be stationary with the Earth. In some instances, reference coordinate system 311 can be selected to be stationary with the user, in particular stationary with respect to movements of the user's head and/or body. In the illustrated example, reference coordinate system 311 is a Cartesian coordinate system comprising a plurality of perpendicular axes, in particular an x-axis 312, a y-axis 313, and a z-axis 314. Alternatively or additionally, other coordinate systems, for instance polar and/or spherical coordinates, may be employed as reference system 311. As another example, quaternions may be employed to describe a rotation and/or orientation in three dimensions and/or complex numbers may be employed to describe a rotation and/or orientation in one dimension, for instance around a central axis of the ear canal.

First displacement sensor 119 may be configured to sense a translational displacement of first hearing device 321 relative to coordinate system 311, for instance a translational displacement 322 relative to x-axis 312 and/or a translational displacement 323 relative to y-axis 313 and/or a translational displacement 324 relative to z-axis 314. Second displacement sensor 129 may be configured to sense a translational displacement of second hearing device 331 relative to coordinate system 311, for instance a translational displacement 332 relative to x-axis 312 and/or a translational displacement 333 relative to y-axis 313 and/or a translational displacement 334 relative to z-axis 314. For example, an accelerometer and/or a magnetometer may be employed to sense the translational displacement along the three different spatial dimensions 312, 313, 314. First displacement sensor 119 may be configured to sense a rotational displacement of first hearing device 321 relative to coordinate system 311, for instance a rotational displacement 326 relative to a plane defined by y-axis 313 and z-axis 314 and/or a rotational displacement 327 relative to a plane defined by x-axis 312 and z-axis 314 and/or a rotational displacement 328 relative to a plane defined by x-axis 312 and y-axis 313. Second displacement sensor 129 may be configured to sense a rotational displacement of second hearing device 331 relative to coordinate system 311, for instance a rotational displacement 336 relative to a plane defined by y-axis 313 and z-axis 314 and/or a rotational displacement 337 relative to a plane defined by x-axis 312 and z-axis 314 and/or a rotational displacement 338 relative to a plane defined by x-axis 312 and y-axis 313. For example, an accelerometer and/or a gyroscope and/or a magnetometer may be employed to sense the rotational displacement within the three different planes spanned by spatial dimensions 312, 313, 314.

First displacement data 211 can thus be indicative of rotational displacement 326, 327, 328 and/or translational displacement 322, 323, 324 of first hearing device 321. Second displacement data 212 can thus be indicative of rotational displacement 336, 337, 338 and/or translational displacement 332, 333, 334 of second hearing device 331. In the example illustrated in FIG. 7B, first hearing device 321 has been subjected to translational displacement 322 and rotational displacement 327 relative to coordinate system 311 as compared to its position and orientation illustrated in FIG. 7A, whereas second hearing device 331 has been left to remain in the same position and orientation relative to coordinate system 311. It may be, however, that a position and/or orientation of coordinate system 311 varies, too. For instance, when coordinate system 311 is stationary with the user, any movement of the user can also lead to a rotational displacement 326-328, 336-338 and/or translational displacement 322-324, 332-334 of first hearing device 321 and second hearing device 331 relative to when coordinate system 311 is stationary with the Earth, for example when the user shaking his head and/or the user is turning his body and/or the user is walking. First displacement data 211 and second displacement data 212 may thus also include information about the movements of the user's head and/or body with respect to coordinate system 311 stationary with the Earth. Such user movement information can be obstructive and/or parasitic when identifying a manual gesture performed by the user on first hearing device 321 based on first displacement data 211 and/or on second hearing device 331 based on second displacement data 212. In order to discount the user movement information from first displacement data 211 and second displacement data 212, a variation measure indicative of a variation of the orientation of first hearing device 321 relative to the orientation of second hearing device 331 and/or a variation of the position of first hearing device 321 relative to the position of second hearing device 331 can be determined.

In some implementations, the variation measure can be determined by comparing first displacement data 211 and second displacement data 212. A deviation between first displacement data 211 and second displacement data 212 can then indicate that a rotational displacement and/or a translational displacement of first hearing device 321 and/or second hearing device 331 is, at least not only, related to a user movement and therefore may be associated with a manual gesture performed by the user on first hearing device 321 and/or second hearing device 331. To illustrate, a movement of the user with his head or body may produce corresponding output values of first displacement sensor 119 when providing first displacement data 211 and second displacement sensor 129 when providing second displacement data 212. A deviation between first displacement data 211 and second displacement data 212, however, may not be attributed to the user's movements which would produce such corresponding output values, and may therefore be related to a manual gesture performed by the user.

An exemplary reference direction 317 and an exemplary reference position 315 is indicated in coordinate system 311. In the illustrated example, reference direction 317 is indicated as a direction substantially parallel or antiparallel to y-axis 313. For instance, reference direction 317 may correspond to a direction of the gravitational force g and/or a direction of the Earth's magnetic field. Reference position 315 is indicated at an origin of coordinate system 311. For instance, reference position 315 may correspond to a position of first hearing device 321 when worn in a resting state at the first ear and/or a position of second hearing device 331 when worn in a resting state at the second ear. The resting state may be defined as a position and/or orientation in which hearing device 321, 331 is worn during regular operating conditions, in particular when no manual gesture is performed on hearing device 321, 331. Reference position 315 of hearing device 321, 331 in the resting state may also be defined as a position of first hearing device 321 and second hearing device 331 relative to one another and/or relative to the user during the regular operating conditions. Reference position 315 and/or reference direction 317 may be selected to be equal or different for first hearing device 321 and second hearing device 331.

In some implementations, the variation measure can be determined by comparing an orientation and/or position of first hearing device 321 relative to reference direction 317 and/or reference position 315 with an orientation and/or position of second hearing device 331 relative to reference direction 317 and/or reference position 315. The variation measure may thus be indicative of a variation of the orientation and/or the position of first hearing device 321 and second hearing device 331 relative to reference direction 317 and/or reference position 315. For instance, a difference between the variation of the orientation and/or the position of first hearing device 321 relative to reference direction 317 and/or reference position 315, and the variation of the orientation and/or the position of second hearing device 331 relative to reference direction 317 and/or reference position 315 may be employed to determine the variation measure.

In some instances, first displacement data 211 provided by first displacement sensor 119 and/or second displacement data 212 provided by second displacement sensor 129 may contain information about the orientation and/or position of first hearing device 321 and/or second hearing device 331 relative to reference direction 317 and/or reference position 315. For example, displacement data 211, 212 provided by an accelerometer may comprise information about an orientation of hearing device 321, 331 relative to the direction of the gravitational force as reference direction 317. Displacement data 211, 212 provided by a magnetometer may comprise information about an orientation of hearing device 321, 331 relative to the direction of the magnetic field of the Earth as reference direction 317.

In some instances, processing unit 210 can be configured to determine the orientation and/or position of first hearing device 321 and/or second hearing device 331 relative to reference direction 317 and/or reference position 315 based on first displacement data 211 and second displacement data 212. For example, processing unit 210 may continuously receive displacement data 211, 212 from first displacement sensor 119 and/or second displacement sensor 129 and continuously monitor the rotational and/or translational displacement relative to reference direction 317 and/or reference position 315. In particular, processing unit 210 may be configured to determine reference direction 317 and/or reference position 315 before monitoring the rotational and/or translational displacement and/or before determining the variation measure. For example, the reference direction and/or the reference position may be determined by processing unit 210 in an initialization operation and/or in a resting state of first hearing device 321 when worn at the first ear and/or second hearing device 331 when worn at the second ear and/or in the absence of a manual gesture performed on first hearing device 321 and/or second hearing device 331. For example, information about the orientation and/or position of first hearing device 321 and/or second hearing device 331 relative to the reference direction and/or reference position, which may be contained in first displacement data 211 and/or second displacement data 212, may be employed by processing unit 210 to determine that first hearing device 321 and/or second hearing device 331 is in the resting state in order to perform the initialization operation.

Figure 8A:
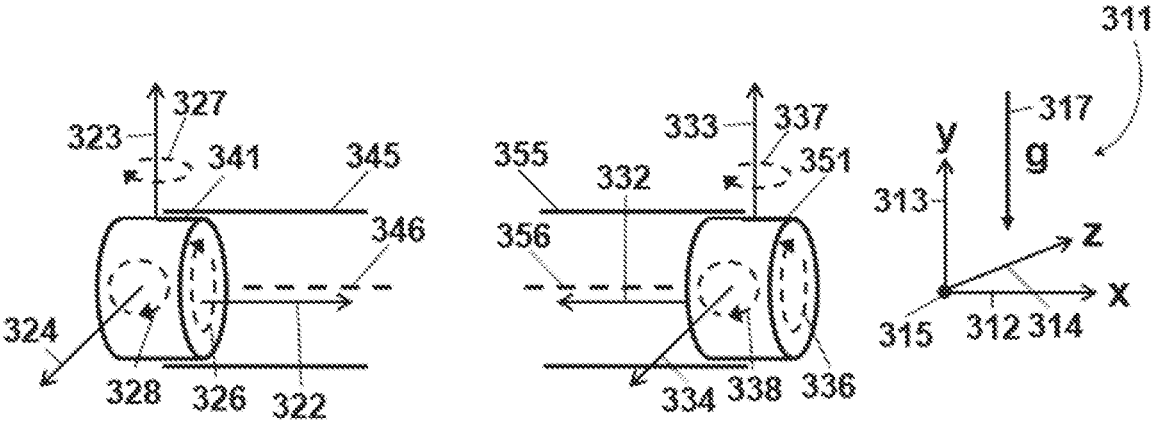
FIGS. 8A, B schematically illustrate some further exemplary configurations of a first hearing device and a second hearing device before and after a displacement of the first hearing device by a manual gesture.
Figure 8B:
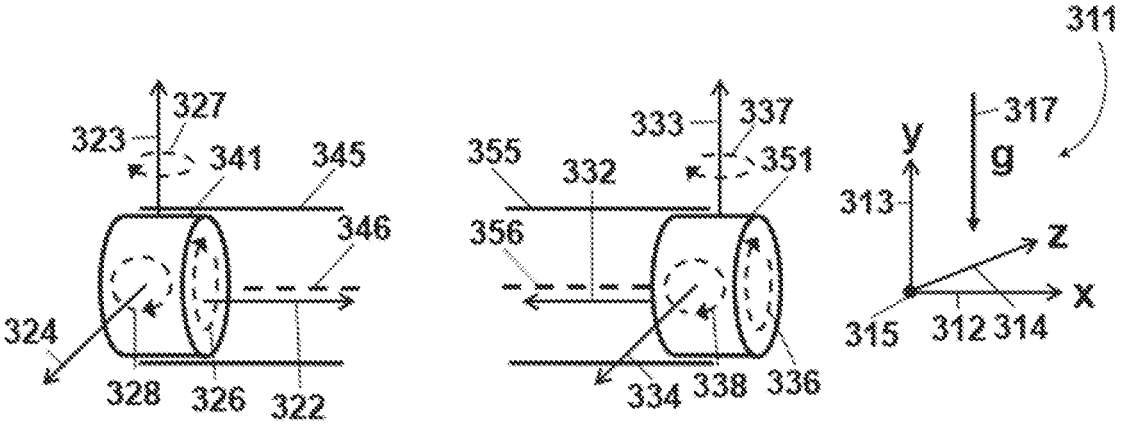

FIG. 8A and FIG. 8B illustrate some exemplary geometrical configurations of a hearing system comprising a first hearing device 341 configured to be worn at a first ear of a user and a second hearing device 351 configured to be worn at a second ear of the user at a wearing position at least partially inside an ear canal. As illustrated, first hearing device 341 may be inserted into an ear canal 345 of the first ear along a central axis 346 of ear canal 345. Second hearing device 351 may be inserted into an ear canal 355 of the second ear along a central axis 356 of ear canal 355. For instance, hearing devices 341, 351 may be implemented as earbud 190 or ITE part 132 of first hearing device 110, 160, and earbud 190 or ITE part 132 of second hearing device 120, 170. Further illustrated are the degrees of freedom of rotational displacement 326-328 and translational displacement 322-324 of first hearing device 341 and rotational displacement 336-338 and translational displacement 332-334 of second hearing device 351, corresponding to hearing devices 321, 331 illustrated in FIGS. 7A, B. In the case of hearing device 341, 351, however, a reactive force of ear canal 345, 355 acting on hearing device 341, 351 may need to be taken into account upon rotational displacement 326-328 and/or translational displacement 322-324.

To illustrate, rotational displacement 326 of first hearing device 341 around central axis 346 and/or rotational displacement 336 of second hearing device 351 around central axis 356 may be performed without substantial obstruction by ear canal 345, 355. Translational displacement 322 of first hearing device 341 along central axis 346 and/or translational displacement 332 of second hearing device 351 along central axis 356 may be limited by a restoring force of ear canal 345, 355 acting in the opposed direction. Correspondingly, translational displacement 323, 333 of hearing device 341, 351 perpendicular to central axis 346, 356 may be limited by ear canal 345, 355 and may further be accompanied by rotational displacement 328, 338 which may be caused by a deformation of ear canal 345, 355 upon translational displacement 323, 333. Similarly translational displacement 324, 334 of hearing device 341, 351 perpendicular to central axis 346, 356 may be increasingly blocked by ear canal 345, 355 and may be accompanied by rotational displacement 327, 337. Translational displacement 323, 333, 324, 334 combined with corresponding rotational displacement 328, 338, 327, 337 may thus be employed to identify a manual gesture, for which a pattern of the combined translational and rotational displacement may be characteristic. Rotational displacement 326, 336 of hearing device 341, 351 around central axis 346, 356 may also be employed to identify a manual gesture with improved reliability due to the absent limitation of displacement 326, 336 by ear canal 345, 355 which may result in an amplitude of displacement 326, 336 significantly larger as compared to other displacements 322-324, 327, 328, 332-334, 337, 338. In the example illustrated in FIG. 8B, first hearing device 341 has been subjected to translational displacement 322 in the direction of central axis 346 and may also have been subjected to rotational displacement 326 around central axis 346 as compared to its position and orientation illustrated in FIG.

8A, whereas second hearing device 351 has been left to remain in the same position and orientation relative to central axis 356.

FIGS. 9A-9H illustrate some manual gestures 411-418 that may be performed on first hearing device 110, 160, 321, 341 and/or second hearing device 120, 170, 331, 351. Manual gestures 411-418 may be performed by the user with a hand 401, for instance with a finger 402 such as an index finger, by a pressing of the respective hearing device in a specific direction for a specific time for a specific number of times.

Figure 9A:
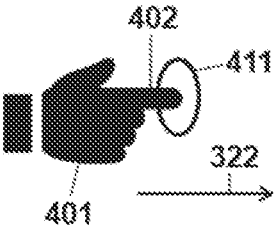
FIGS. 9A-H schematically illustrate examples of some manual gestures that may be performed by a user on the first hearing device and/or the second hearing device illustrated in FIGS. 1, 3, 7A, B, 8A, B by at least one manual pressing.

FIG. 9A illustrates a tapping 411 of the first hearing device in the direction of x-axis 312, which may correspond to a tapping in the direction of central axis 346, 356 when the hearing device is at least partially inserted into ear canal 345, 355. Tapping, as used herein, implies a short press, in particular pressing the hearing device in the specific direction for less than a predefined time, for instance for less than one second or less than half a second. This can result in translational displacement 322 of the first hearing device. A corresponding tapping on the second hearing device can result in translational displacement 332 of the second hearing device. The variation measure can then indicate a corresponding variation of the position of the first hearing device relative to the position of the second hearing device. A pattern characteristic for tapping 411 may define a minimum amount of the relative variation between the first displacement data and the second displacement data. The minimum amount of the variation may include, for instance, an amplitude of the variation measure and/or a slope of the amplitude exceeding a threshold. The pattern characteristic for tapping 411 may also define a temporal characteristic of the variation, for instance a duration of translational displacement 322 not exceeding said predefined time.

Figure 9B:
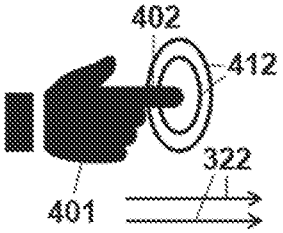

FIG. 9B illustrates a double tapping 412 in the direction of x-axis 312, which may correspond to two consecutive tappings in the direction of central axis 346, 356 when the hearing device is at least partially inserted into ear canal 345, 355. As shown, this can result in two subsequent translational displacements 322 of the first hearing device. A pattern characteristic for double tapping 412 may define a minimum amount of the variation between the first displacement data and the second displacement data, as described above, and/or a temporal characteristic of the variation, for instance a quiet period between the two subsequent tappings not exceeding a maximum period.

Figure 9C:
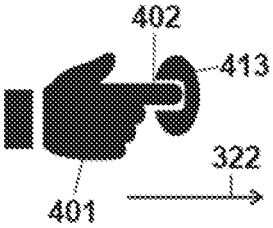

FIG. 9C illustrates a long press 413 in the direction of x-axis 312. Long press 413 may be executed by pressing the hearing device in the specific direction for longer than the predefined time which is not exceeded by tapping 411, 412 illustrated in FIGS. 9A, B. Thus, translational displacement 322 of the first hearing device will occur for a longer time. A pattern characteristic for long press 413 may define a minimum amount of the variation between the first displacement data and the second displacement data and/or a temporal characteristic of the variation, for instance a duration of translational displacement 322 exceeding said predefined time characteristic for tapping 411.

Figure 9D:
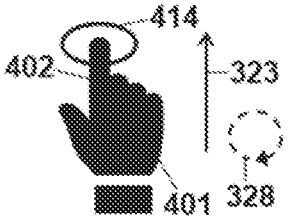

FIG. 9D illustrates a tapping 414 of the first hearing device in the direction of y-axis 313 in an upward direction, as seen from the Earth's surface, resulting in translational displacement 323 of the first hearing device. As illustrated, for instance when the hearing device is at least partially inserted into ear canal 345, 355, translational displacement 323 may be accompanied by rotational displacement 328 or rotational displacement 328 may occur in the place of translational displacement 323 due to a confinement of the first hearing device inside the ear canal. The variation measure can then indicate a corresponding variation of the position and/or orientation of the first hearing device relative to the position and/or orientation of the second hearing device. A pattern characteristic for tapping 414 may define a minimum amount of the variation between the first displacement data and the second displacement data and/or a temporal characteristic of the variation. In particular, when rotational displacement 328 and translational displacement 323 complement each other, the pattern may define features of both displacements which may allow an increased reliability of the identification of the manual gesture.

Figure 9E:
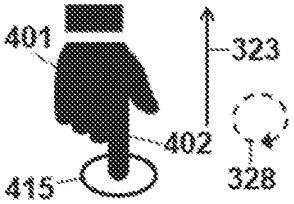

FIG. 9E illustrates a tapping 415 of the first hearing device in the direction of y-axis 313 in a downward direction, as seen from the Earth's surface. A pattern characteristic for tapping 415 may define the features of rotational displacement 328 and/or translational displacement 323 of the pattern characteristic for tapping 414 described above, wherein a direction characteristic for the respective displacement 328, 323 is inversed.

Figure 9F:
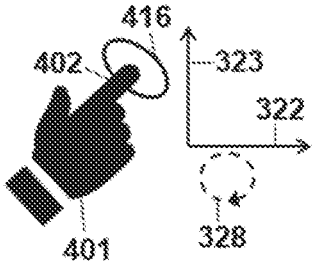

FIG. 9F illustrates a tapping 416 of the first hearing device in a transverse direction extending in a plane spanned by x-axis 312 and y-axis 313. A pattern characteristic for tapping 415 may define the features of translational displacement 322 and rotational displacement 328 and/or translational displacement 323 of the pattern characteristic for tapping 411 and tapping 414 described above.

Figure 9G:
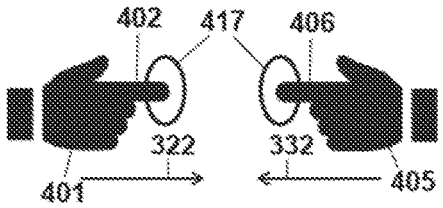

FIG. 9G illustrates a simultaneous tapping 417 of the first hearing device and the second hearing device in the direction of x-axis 312, for instance by finger 402 of first hand 401 such as the user's left hand and a finger 406 of a second hand 405 such as the user's right hand, resulting in translational displacements 322, 332 in an opposed direction. A pattern characteristic for tapping 417 may define a minimum amount of the variation between the first displacement data and the second displacement data and/or a temporal characteristic of the variation. In particular, when the hearing devices are at least partially inserted into ear canal 345, 355, a maximum amount of translational displacements 322, 332 may be limited by the ear canal confinement. Thus, the minimum amount of the variation defined by the pattern may correspond to a relative distance between the hearing devices that may only be achievable by simultaneous tapping 417. A pattern characteristic for tapping 417 may also define a minimum amount and/or a temporal characteristic of a variation of a position of the first hearing device relative to a reference position and/or a variation of a position of the second hearing device relative to a reference position in order to identify simultaneous tapping 417. The variation measure may also be based on environmental data provided by an environmental sensor included in the first hearing device and/or second hearing device to provide further evidence of simultaneous tapping 417, wherein the pattern characteristic for simultaneous tapping 417 may define at least one feature of the environmental data.

Figure 9H:
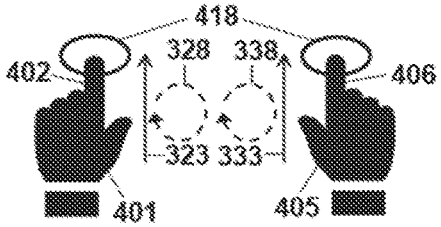

FIG. 9H illustrates a simultaneous tapping 418 of the first hearing device and the second hearing device in the direction of y-axis 312 resulting in translational displacements 322, 332 in the same direction and/or rotational displacements 328, 338 in opposed directions. Another embodiment may comprise a simultaneous tapping 418 parallel to y-axis 312 resulting in translational displacements 322, 332 in opposed directions and/or rotational displacements 328, 338 in the same direction. A pattern characteristic for this manual gesture may define features of both displacements 322, 328 of the first hearing device and both displacements 332, 338 of the second hearing device allowing a reliable identification of simultaneous tapping 418.

Figure 10A:
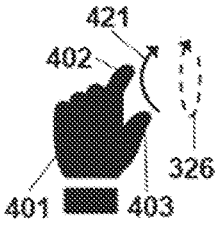
FIGS. 10A-C schematically illustrate examples of some manual gestures that may be performed by a user on the first hearing device and/or the second hearing device illustrated in FIGS. 1, 3, 7A, B, 8A, B by at least one manual rotating.
Figure 10B:
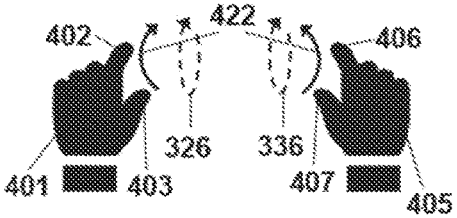
Figure 10C:
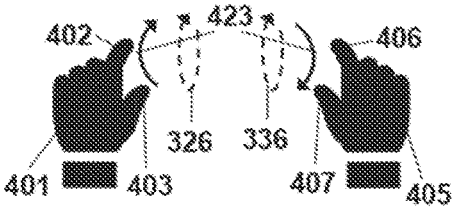

FIGS. 10A-10C illustrate some further manual gestures 421-423 that may be performed on first hearing device 110, 160, 321, 341 and/or second hearing device 120, 170, 331, 351 by the user with his hand 401, for instance with two fingers 402, 403 such as an index finger and a thumb, by a rotating the respective hearing device in a specific direction for a specific time for a specific number of times.

FIG. 10A illustrates a rotating 421 of the first hearing device within the plane spanned by y-axis 313 and z-axis 314 resulting in rotational displacement 326. In particular, when the hearing device is inserted into ear canal 345, 355, the rotation may be carried out around central axis 346, 356 of the ear canal. A corresponding rotating of the second hearing device can result in rotational displacement 336 of the second hearing device. The variation measure can then indicate a corresponding variation of the orientation of the first hearing device relative to the orientation of the second hearing device. A pattern characteristic for a rotating 421 may define a minimum amount of the variation between the first displacement data and the second displacement data. The minimum amount of the variation may include, for instance, an amplitude of the variation measure and/or a slope of the amplitude exceeding a threshold. The pattern characteristic for rotating 421 may also define a temporal characteristic of the variation, for instance a minimum and/or maximum duration during which the hearing device is rotated and/or during which the hearing device is in the rotated position.

FIG. 10B illustrates a simultaneous rotating 422 of the first hearing device and the second hearing device, for instance by fingers 402, 403 of first hand 401 and fingers 406, 407 of second hand 405, within the plane spanned by y-axis 313 and z-axis 314 resulting in rotational displacements 326, 336 in the same direction. In this case, a relative orientation and/or position of the hearing devices may substantially not vary and/or only vary by a small amount due to imprecisions of the user when carrying out the gesture which may lead to fluctuations in the relative orientation and/or position. A pattern characteristic for rotating 422 may thus define a maximum amount of the variation between the first displacement data and the second displacement data and/or a temporal characteristic of the variation. In addition, the pattern may define a minimum amount and/or a temporal characteristic of a variation of the position of the first hearing device relative to a reference direction, for instance direction 317 of the gravitational force, and/or a variation of a position of the second hearing device relative to the reference position. The pattern may further define a feature of environmental data provided by an environmental sensor included in the first hearing device and/or second hearing device.

FIG. 10C illustrates a simultaneous rotating 423 of the first hearing device and the second hearing device within the plane spanned by y-axis 313 and z-axis 314 resulting in rotational displacements 326, 336 in opposed directions. A pattern characteristic for rotating 423 may define a minimum amount of the variation between the first displacement data and the second displacement data and/or a temporal characteristic of the variation. The pattern may also define an orientation variation of the first hearing device and/or the second hearing device relative to a reference direction and/or a feature of environmental data.

FIGS. 11A-11D illustrate some further manual gestures 431-434 that may be performed on first hearing device 110, 160, 321, 341 and/or second hearing device 120, 170, 331, 351. Manual gestures 431-434 may be performed by the user with hand 401, for instance with finger 402 such as an index finger, by wiping on a surface and/or swiping over a surface of the respective hearing device in a specific direction for a specific time for a specific number of times.

Figure 11A:
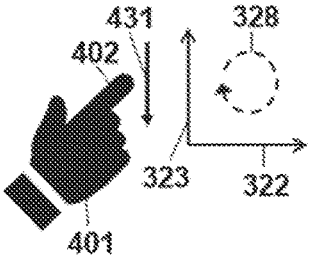
FIGS. 11A-D schematically illustrate examples of some manual gestures that may be performed by a user on the first hearing device and/or the second hearing device illustrated in FIGS. 1, 3, 7A, B, 8A, B by at least one manual swiping.

FIG. 11A illustrates a swiping 431 of the first hearing device in the direction of y-axis 313. As illustrated, swiping 431 may cause translational displacement 322 of the hearing device in the direction of x-axis 312 perpendicular to the direction in which swiping 431 is carried out due to an initial contacting of the hearing device by the user's hand 401 required to carry out the swiping. After the manual contacting, swiping 431 can cause rotational displacement 328 and/or translational displacement 323 of the hearing device which can be attributed to the actual swiping movement of the user's hand 401. A pattern characteristic for swiping 431 may define a minimum amount of the variation between the first displacement data and the second displacement data resulting from translational displacement 322 and/or rotational displacement 328 and/or translational displacement 328 and/or a temporal characteristic of the variation. The temporal characteristic may include, for instance, a temporal sequence of the displacements, in particular translational displacement 322 occurring before rotational displacement 328 and/or translational displacement 328.

Figure 11B:
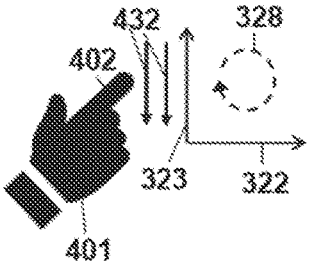

FIG. 11B illustrates a swiping 432 of the first hearing device twice in the same direction parallel to y-axis 313. A pattern characteristic for double swiping 432 may define a minimum amount of the variation between the first displacement data and the second displacement data and/or a temporal characteristic of the variation corresponding to swiping 431. The pattern may further define an additional temporal characteristic of the variation, for instance a quiet period between the first and second swiping.

Figure 11C:
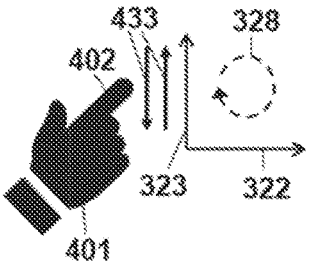

FIG. 11C illustrates a swiping 433 of the first hearing device twice in opposed directions parallel to y-axis 313. The first and second swiping can cause rotational displacement 328 and/or translational displacement 323 of the hearing device in opposed directions. A pattern characteristic for double swiping 433 may define a corresponding behavior of the relative variation between the first displacement data and the second displacement data.

Figure 11D:
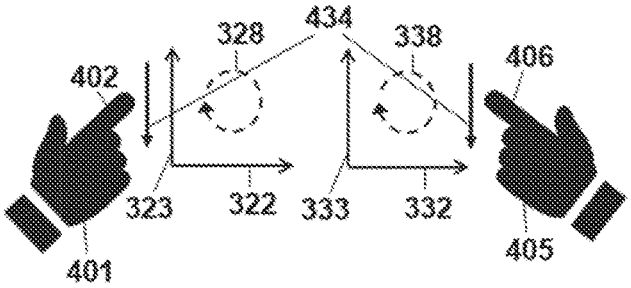

FIG. 11D illustrates a simultaneous swiping 434 of the first hearing device and the second hearing device in the direction of y-axis 313, for instance by finger 402 of first hand 401 and finger 406 of second hand 405, resulting in translational displacements 322, 332 in opposed directions and/or rotational displacements 328, 338 and/or translational displacements 323, 333 in the same direction. A pattern characteristic for simultaneous swiping 434 may define a corresponding behavior of the relative variation between the first displacement data and the second displacement data.

Figure 12:
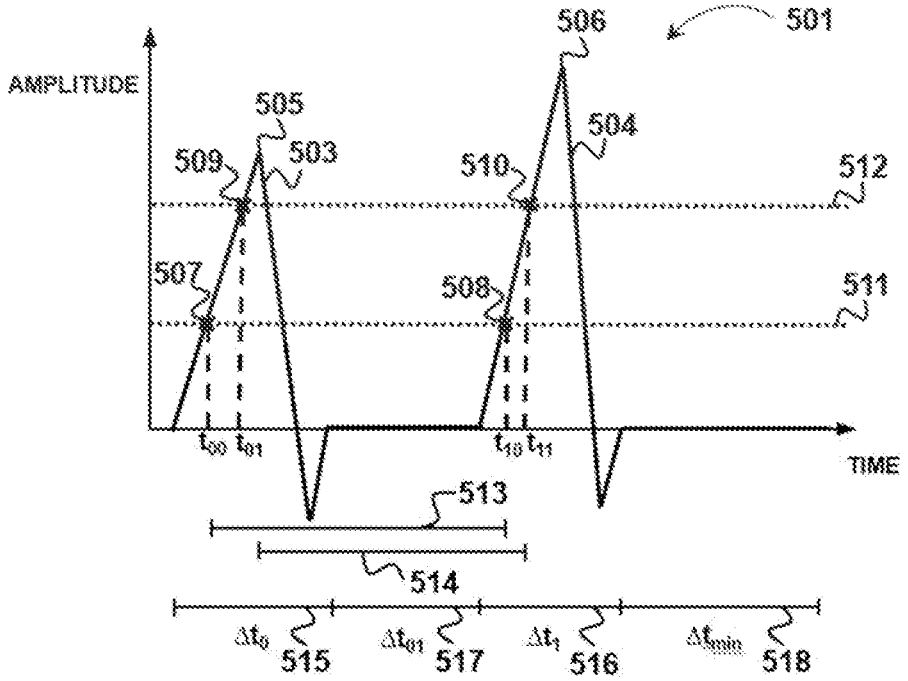
FIG. 12 schematically illustrates a graph of displacement data in response to a manual gesture performed by a user on the first hearing device and/or the second hearing device illustrated in FIGS. 1, 3, 7A, B, 8A, B by two subsequent manual tappings based on which a variation measure can be determined.

FIG. 12 illustrates an exemplary graph 501 of displacement data that may be provided by first displacement sensor 119 while the user is performing a double tapping on first hearing device 110, 160, 321, 341, as illustrated in FIG. 9B, in particular when substantially no additional movement is carried out by the user. The illustrated first displacement data can be, for instance, a single axis component of a three-dimensional data output by an accelerometer. The graph 501 shows two signal pulses 503, 504 over time produced by two taps, a first tap 503 followed by a second tap 504. Simultaneously, the second displacement data can be provided by second displacement sensor 129. The second displacement data may be illustrated by another graph, which is not shown, having a substantially constant amplitude over time when no manual gesture is performed by the user on second hearing device 120, 170, 331, 351 and when substantially no additional movement is carried out by the user. In some implementations, the variation measure may be determined as a difference between the amplitudes of first displacement data 501 and the second displacement data over time. In this case, the variation measure indicative of a variation of the position of the first hearing device relative to the position of the second hearing device exhibits the same characteristic behavior illustrated by graph 501 including two signal pulses 503, 504 over time.

In another case, in which the user performs an additional movement when performing double tapping 412 illustrated in FIG. 9B, for instance by moving his head or body or when driving a vehicle, the first displacement data may include an additional amplitude or offset added to the temporal behavior illustrated in graph 501 which is caused by the additional movement. Since such an additional movement can be equally sensed by first displacement sensor 119 and second displacement sensor 129, the second displacement data will be equally affected by the additional movement of the user. The second displacement data then substantially represents the additional amplitude or offset caused by the additional user movement over time. The variation measure determined as a difference between the amplitudes of the first displacement data and the second displacement data will then exhibit the same characteristic behavior illustrated by graph 501 including the two signal pulses 503, 504 over time, since the additional amplitude or offset will be cancelled out by taking the difference. In this way, a reliability of identifying a manual gesture based on the displacement data can be enhanced by determining whether the variation measure matches the pattern characteristic for the manual gesture. Moreover, various kinds of manual gestures can thus be identified which would be hard to distinguish when solely based on the first displacement data or the second displacement data independent from one another.

Graph 501 may thus represent the variation measure determined based on the first displacement data and the second displacement data when the user is performing double tapping 412 illustrated in FIG. 9B. During first tapping 503, the variation measure has a peak in amplitude at 505, and during second tapping, the variation measure has a peak in amplitude at 506. First tapping 503 has measurable displacement effects that last for a duration period 515 and second tapping 504 has measurable effects that last for duration period 516. Each pulse 503, 504 has a positive slope until peak 505, 506. After the peak 505, 506, there is a shock period that relates to the acceleration of the first hearing device in response to the tap. During the shock period, each pulse 503, 504 has a negative slope, which indicates a displacement in the opposite direction. As shown, the slope may change sign several times during the shock period.

The positive slope before peaks 505, 506 can be employed as a pattern characteristic for the tapping gesture performed by the user. For example, variation measure 501 may only match the pattern if the respective slope is above a slope threshold. The slope may be identified by determining a time interval between a first data range 507, 508 at which the movement data crosses a first amplitude threshold 511 from below the threshold to above the threshold, and a second data range 509, 510 at which the movement data crosses a second amplitude threshold 512 larger than first amplitude threshold 511 from below the threshold to above the threshold. More generally, a pattern characteristic for the tapping gesture may define a minimum amount of the deviation between the first displacement data and the second displacement data indicated by variation measure 501, which may include a predefined value of the slope threshold and/or amplitude threshold 511, 512 to be exceeded by variation measure 501. In particular, the slope threshold may define the minimum amount of the deviation per time. Amplitude threshold 511, 512 may define the minimum amount of the deviation in absolute terms.

Additionally shown, there is a quiet period 517 between the first tapping and the second tapping, which refers to when little to no changes in the variation of the position of the first hearing device relative to the position of the second hearing device are determined. Quiet period 517 can be used as a temporal characteristic of the pattern characteristic for double tapping 412. Double tapping 412 may thus be distinguished from single tapping 411 and/or a triple tapping depending on quiet period 517 not exceeding a maximum period 518. The number of identified movement features 507-510 separated by a time interval smaller than maximum period 518 can be used as another pattern characteristic for double tapping 412. A time interval 513 between first threshold crossing points 507, 508 and/or a time interval 514 between second threshold crossing points 509, 510 can be used as another temporal characteristic of the pattern characteristic for double tapping 412.

Figure 13:
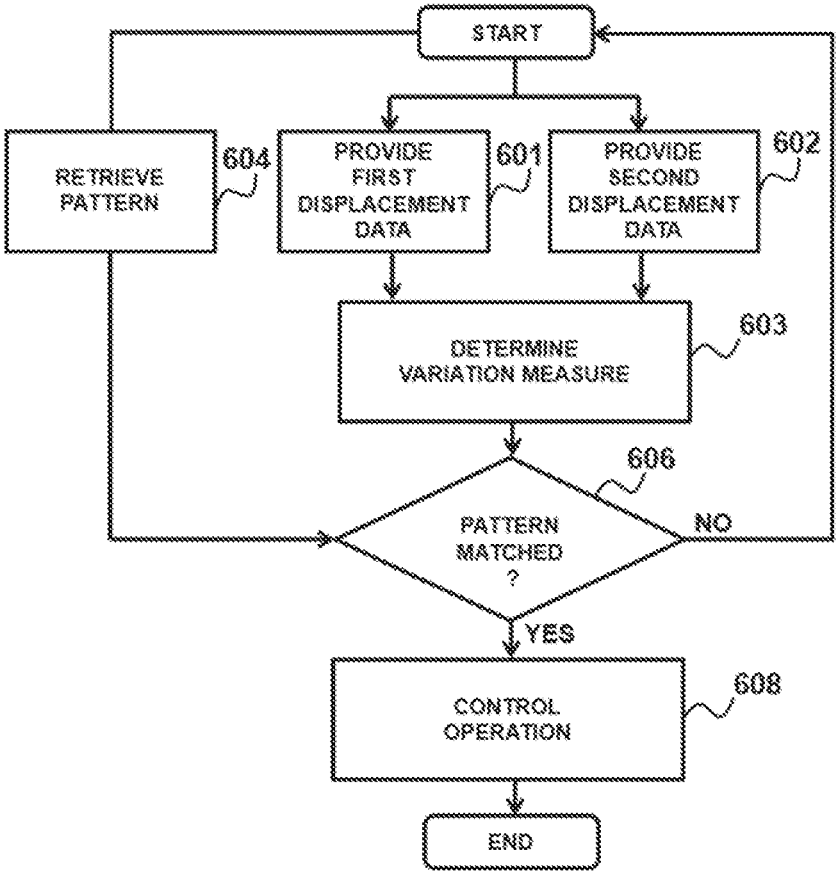
FIG. 13 illustrates an exemplary method of operating a hearing system according to principles described herein.

FIG. 13 illustrates a block flow diagram for an exemplary method of operating hearing system 100, 150. The method may be executed by processing unit 210, in particular when executing the data processing algorithm illustrated in FIG. 6. At 601, first displacement data 211 is provided by first displacement sensor 119. At 602, second displacement data 212 is provided by first displacement sensor 129. First and second displacement data 211, 212 may be sensed substantially simultaneously by displacement sensors 119, 129 and/or may be provided at substantially corresponding times to processing unit 210 in order to obtain a meaningful relationship between displacement data 211, 212, for instance when mutually comparing and/or subtracting and/or correlating displacement data 211, 212 for determining the variation measure. At 603, the variation measure is determined based on displacement data 211, 212. Before and/or concurrently to operations 601-603, a pattern characteristic for a manual gesture performed on first hearing device 110, 160, 321, 341 and/or second hearing device 120, 170, 331, 351 is retrieved at 604. For instance, pattern data 217 may be retrieved from database 218 and/or the pattern may be at least partially permanently implemented in a program run by processing unit 210 when executing the data processing algorithm. In particular, multiple patterns characteristic for different manual gestures may be retrieved and/or permanently implemented. At 606, it is determined whether the variation measure matches at least one of the patterns. When the variation measure matches the pattern, an operation of the hearing system is controlled at 608. In the contrary case, the method may be repeated based on updated displacement data 211, 212 provided at 601, 602.

Figure 14:
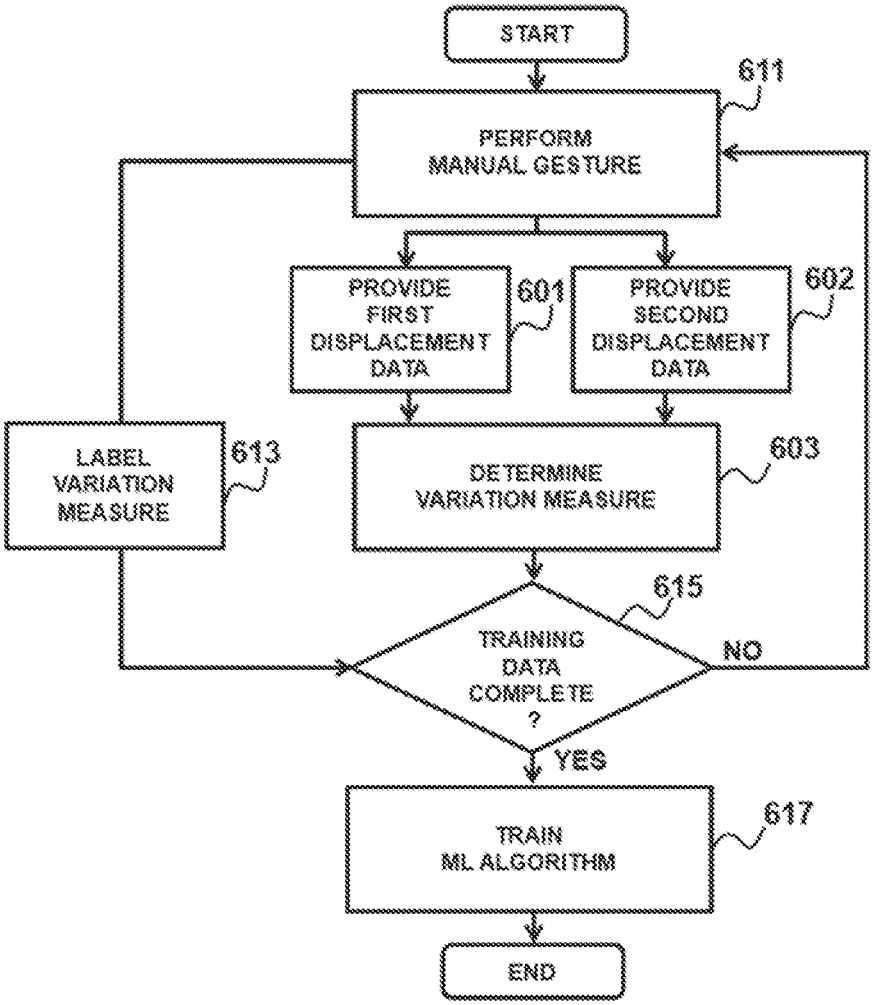
FIG. 14 illustrates an exemplary method of preparing a hearing system to operate according to principles described herein.

FIG. 14 illustrates a block flow diagram for an exemplary method of providing a pattern characteristic for a manual gesture performed on first hearing device 110, 160, 321, 341 and/or second hearing device 120, 170, 331, 351. In the example, the provided pattern is implemented in a trained machine learning (ML) algorithm. The ML algorithm may be executed by processing unit 420, in particular by pattern recognition module 214, when determining whether the variation measure matches the pattern, in particular during operation 606 of the method illustrated in FIG. 13. The method comprises operations 611-617 of obtaining training data based on which the ML algorithm can be trained, and operation 617 of training the ML algorithm. The method requires a personal interaction of at least one user and comprises a further processing of data obtained from the user interaction which may be at least partially executed by processing unit 420 and/or by a plurality of processing units 420, which may be implemented in a plurality of hearing systems 100, 150, and/or by another processing unit which may be operated independently of hearing systems 100, 150.

At 611, a manual gesture is performed on the first hearing device and/or the second hearing device. Operations 601, 602 of providing first and second displacement data and operation 603 of determining the variation measure based on the displacement data 211, 212 may then be performed as described above. Afterwards, at 613, the variation measure is labelled such that it can be associated with the manual gesture performed at 611. Further labels of the variation measure may include information about a user performing the manual gesture at 611, for instance to allow a distinction between variation measures obtained from different users, different age groups, etc., and/or information about an environment in which the manual gesture has been performed, and/or information about a type of the hearing device on which the manual gesture has been performed. The labelled variation measure may then be stored. These operations may be repeated for a sufficient number of times in order to obtain a set of variation measures allowing a satisfactory training of the ML algorithm. The training set may include variation measures obtained from a single user and/or hearing system, or variation measures obtained from a plurality of different users and/or hearing systems. At 615, it is determined whether the training set is complete. In particular, when it is determined that the training set includes a large enough number of variation measures representative for the manual gesture, it can be employed to train the ML algorithm at 617.

Training of the ML algorithm at 617 may thus be performed after obtaining a complete training set at 615. However, the trained ML algorithm may be further adjusted based on updated training data which may be obtained in accordance with operations 611 and 613 described above, for instance during a regular and/or daily usage of the hearing system by the user. Further adjustment of the trained ML algorithm may be performed dynamically and/or on-the-fly and/or in a dedicated subsequent training. Various types of ML algorithms may be utilized to determine whether the variation measure matches a pattern characteristic for a manual gesture at operation 606. For instance, the ML algorithm may include a (deep) neural network, a convolutional neural network, an algorithm based on Multivariate analysis of variance (Manova), a support vector machine (SVM), a Hidden Markov Model (HMM) or any other ML algorithm or pattern recognition algorithm.

While the principles of the disclosure have been described above in connection with specific devices, systems, and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

What is claimed is:

1. A hearing system comprising a first hearing device configured to be worn at a first ear of a user, the first hearing device comprising a first displacement sensor configured to provide first displacement data indicative of a rotational displacement and/or a translational displacement of the first hearing device;

a second hearing device configured to be worn at a second ear of the user, the second hearing device comprising a second displacement sensor configured to provide second displacement data indicative of a rotational displacement and/or a translational displacement of the second hearing device; and a processing unit communicatively coupled to the first displacement sensor and to the second displacement sensor, characterized in that the processing unit is configured to determine, based on the first displacement data and the second displacement data, a variation measure indicative of a variation of an orientation of the first hearing device relative to an orientation of the second hearing device and/or a variation of a position of the first hearing device relative to a position of the second hearing device; to determine whether the variation measure matches a pattern characteristic for a manual gesture performed on the first hearing device and/or the second hearing device, the pattern defining a minimum amount of the variation and/or a temporal characteristic of the variation; and to control an operation of the hearing system when the variation measure matches the pattern.

2. The hearing system according to claim 1, characterized in that the pattern is characteristic for:

at least one manual pressing on the first hearing device and/or the second hearing device; and/or at least one manual rotating of the first hearing device and/or the second hearing device; and/or at least one manual swiping on the first hearing device and/or the second hearing device.

3. The hearing system according to claim 1, characterized in that the first hearing device is configured to be at least partially inserted into an ear canal of the first ear and the second hearing device is configured to be at least partially inserted into an ear canal of the second ear, wherein the pattern is characteristic for:

at least one manual rotating of the first hearing device and/or the second hearing device around a central axis of the ear canal of the first ear and/or the second ear; and/or at least one manual pressing and/or at least one manual swiping on the first hearing device and/or the second hearing device causing a displacement of the first hearing device and/or the second hearing device along the central axis.

4. The hearing system according to claim 1, characterized in that the controlling of the operation comprises:

adjusting an audio output of the first hearing device and/or the second hearing device; and/or adjusting a parameter of an audio processing program executed by the processing unit; and/or adjusting a parameter of a sensor data processing program executed by the processing unit; and/or toggling between different programs executed by the processing unit; and/or accepting and/or declining the operation; and/or putting the operation, when executed by the processing unit, into a stand by mode in which the operation is not further executed and/or restoring the operation from the stand by mode into a running mode in which the operation is further executed; and/or adjusting a power consumption of the first hearing device and/or the second hearing device; and/or rebooting an operation system and/or turning off the first hearing device and/or the second hearing device; and/or performing a communication between the first hearing device and the second hearing device; and/or performing a communication between the first hearing device and/or the second hearing device and a remote device configured to be operated by the user remote from the first ear and the second ear; and/or performing a communication of the hearing system with an external device.

5. The hearing system according to claim 1, characterized in that the variation measure is indicative of a deviation between the first displacement data and the second displacement data.

6. The hearing system according to claim 1, characterized in that the processing unit is configured to determine, based on the first displacement data and the second displacement data, a variation between an orientation of the first hearing device relative to a reference direction and an orientation of the second hearing device relative to the reference direction; and/or a variation between a position of the first hearing device relative to a reference position and a position of the second hearing device relative to the reference position, wherein the variation measure is indicative of the variation of the orientation and/or the position of the first hearing device and the second hearing device relative to the reference direction and/or the reference position.

7. The hearing system according to claim 6, characterized in that the reference direction is the direction of a gravitational force and/or the Earth's magnetic field.

8. The hearing system according to claim 1, characterized in that the first displacement sensor and/or the second displacement sensor comprises an inertial sensor and/or a magnetometer.

9. The hearing system according to claim 1, characterized in that the first hearing device and/or the second hearing device further comprises an environmental sensor configured to provide environmental data indicative of a property of an ambient environment of the first hearing device and/or the second hearing device, wherein the processing unit is configured to determine the variation measure based on the environmental data in addition to the first displacement data and the second displacement data.

10. The hearing system according to claim 9, characterized in that the environmental sensor comprises a capacitive sensor configured to provide capacitance data indicative of a capacitive coupling of the first hearing device and/or the second hearing device with an ambient environment; and/or a resistive sensor configured to provide resistance data indicative of an electrical resistance at an interface between the first hearing device and/or the second hearing device and the ambient environment; and/or a sound sensor configured to provide sound data indicative of sound detected in the ambient environment; and/or a light sensor configured to provide optical data indicative of light detected in the ambient environment; and/or a proximity sensor configured to provide proximity data indicative of a presence of an object in a proximity of the first hearing device and/or the second hearing device, wherein the environmental data comprises the capacitance data and/or the resistance data and/or the sound data and/or the optical data and/or the proximity data.

11. The hearing system according to claim 1, characterized in that the processing unit comprises a first processor included in the first hearing device configured to receive the first displacement data, and a second processor included in the second hearing device configured to receive the second displacement data, wherein the first processor and the second processor are communicatively coupled with each other.

12. The hearing system according to claim 1, wherein the pattern is a first pattern characteristic for a first manual gesture, wherein the processing unit is configured to determine whether the variation measure matches a second pattern characteristic for a second manual gesture performed on the first hearing device and/or the second hearing device.

13. A hearing system comprising:

a first hearing device configured to be worn at a first ear of a user, the first hearing device comprising a first displacement sensor configured to provide first displacement data indicative of a rotational displacement and/or a translational displacement of the first hearing device;

a second hearing device configured to be worn at a second ear of the user, the second hearing device comprising a second displacement sensor configured to provide second displacement data indicative of a rotational displacement and/or a translational displacement of the second hearing device; and a processing unit communicatively coupled to the first displacement sensor and to the second displacement sensor, characterized in that the processing unit is configured to determine, based on the first displacement data and the second displacement data, a variation measure indicative of a variation of an orientation of the first hearing device relative to an orientation of the second hearing device and/or a variation of a position of the first hearing device relative to a position of the second hearing device; to determine whether the variation measure matches a pattern characteristic for a manual gesture performed on the first hearing device and/or the second hearing device; and to control an operation of the hearing system when the variation measure matches the pattern, wherein the pattern is a first pattern characteristic for a first manual gesture, wherein the processing unit is configured to determine whether the variation measure matches a second pattern characteristic for a second manual gesture performed on the first hearing device and/or the second hearing device.

14. A method of operating a hearing system, the hearing system comprising a first hearing device configured to be worn at a first ear of a user, the first hearing device comprising a first displacement sensor configured to provide first displacement data indicative of a rotational displacement and/or a translational displacement of the first hearing device; and a second hearing device configured to be worn at a second ear of the user, the second hearing device comprising a second displacement sensor configured to provide second displacement data indicative of a rotational displacement and/or a translational displacement of the second hearing device, characterized in that the method comprises determining, based on the first displacement data and the second displacement data, a variation measure indicative of a variation of an orientation of the first hearing device relative to an orientation of the second hearing device and/or a variation of a position of the first hearing device relative to a position of the second hearing device;

determining whether the variation matches a pattern characteristic for a manual gesture performed on the first hearing device and/or the second hearing device, the pattern defining a minimum amount of the variation and/or a temporal characteristic of the variation; and controlling an operation of the hearing system when the variation measure matches the pattern.

15. A non-transitory computer-readable medium storing instructions that, when executed by a processing unit, cause the processing unit to perform the method according to claim 14.

* * * * *